US009001488B2

(12) United States Patent
Kaiser et al.

(10) Patent No.: US 9,001,488 B2
(45) Date of Patent: Apr. 7, 2015

(54) STATIC ELECTRICITY DISSIPATION DRAIN AND STANDOFFS FOR BY-PASS CONDUCTORS OF FLOATING ROOF TANKS

(71) Applicants: Bruce A. Kaiser, Clearwater, FL (US); James R. Oldham, Woodstock, VT (US); John R. Battle, Clearwater, FL (US)

(72) Inventors: Bruce A. Kaiser, Clearwater, FL (US); James R. Oldham, Woodstock, VT (US); John R. Battle, Clearwater, FL (US)

(73) Assignee: Lightning Master Corporation, Clearwater, FL (US)

( * ) Notice: Subject to any disclaimer, the term of this patent is extended or adjusted under 35 U.S.C. 154(b) by 117 days.

(21) Appl. No.: 13/657,816

(22) Filed: Oct. 22, 2012

(65) Prior Publication Data

US 2013/0176656 A1 Jul. 11, 2013

Related U.S. Application Data

(60) Provisional application No. 61/684,857, filed on Aug. 20, 2012, provisional application No. 61/550,001, filed on Oct. 21, 2011.

(51) Int. Cl.

| | |
|---|---|
| ***H05F 3/00*** | (2006.01) |
| ***H01R 43/00*** | (2006.01) |
| ***H05F 1/00*** | (2006.01) |
| ***H01R 43/26*** | (2006.01) |
| ***H01R 3/08*** | (2006.01) |
| ***H01R 4/64*** | (2006.01) |
| ***B65D 90/46*** | (2006.01) |

(52) U.S. Cl.

CPC ..... *H05F 1/00* (2013.01); *H01R 43/26* (2013.01); *H01R 3/08* (2013.01); *H01R 4/64* (2013.01); *B65D 90/46* (2013.01)

(58) Field of Classification Search

USPC ..... 361/215; 29/825; 200/216, 220

See application file for complete search history.

(56) References Cited

U.S. PATENT DOCUMENTS

| | | | | |
|---|---|---|---|---|
| 1,617,788 | A | 2/1927 | Baldwin et al. | |
| 1,678,539 | A | 7/1928 | Ticehurst | |
| 1,743,788 | A | 1/1930 | McKeon | |
| 1,757,172 | A | 5/1930 | Cazel et al. | |
| 1,793,911 | A * | 2/1931 | Dann | 439/777 |
| 1,974,315 | A | 9/1934 | Schaeffer | |
| 2,631,189 | A | 3/1953 | Sullivan et al. | |
| 3,453,493 | A * | 7/1969 | Godwin, Jr. | 361/215 |

(Continued)

OTHER PUBLICATIONS

Alan Roachell & Bruce Kaiser, "Static Lightning protection for tanks" Well Servicing May/Jun. 2010.

*Primary Examiner* — Scott Bauer

(74) *Attorney, Agent, or Firm* — GrayRobinson, P.A.

(57) ABSTRACT

A bonding system for a tank battery containing a flammable or combustible product being stored or conveyed, including a bonding conductor, an electrically conductive base member mounted on the tank, the electrically-conductive base member electrically connected to the bonding conductor and to ground installed within each tank and also including a flexible conductive medium with an upper end and a lower end and a plurality of fine electrically-conductive metal wires each having a proximal end and a terminal end, the proximal ends of which are intertwined with the flexible conductive medium to be in electrical connection with the electrical conductive medium, the upper end of the flexible conductive medium electrically connected with the electrically conductive base member and a plurality of static drains located proximate to the highest points of the tank battery and electrically bonded to said bonding conductor.

4 Claims, 29 Drawing Sheets

(56) References Cited

U.S. PATENT DOCUMENTS

| | | | | | |
|---|---|---|---|---|---|
| 3,617,805 | A | | 11/1971 | Truax | |
| 3,942,674 | A | * | 3/1976 | Nelson | 220/221 |
| 4,180,698 | A | | 12/1979 | Carpenter, Jr. | |
| 4,605,814 | A | | 8/1986 | Gillem | |
| 4,910,636 | A | | 3/1990 | Sadler et al. | |
| 5,123,559 | A | * | 6/1992 | Qiu et al. | 220/218 |
| 5,638,248 | A | | 6/1997 | Fawthrop | |
| 5,694,286 | A | | 12/1997 | Fowler et al. | |
| 6,307,149 | B1 | | 10/2001 | Zini et al. | |
| 6,369,317 | B1 | | 4/2002 | Rapp | |
| D478,294 | S | | 8/2003 | Haygood | |
| D478,295 | S | | 8/2003 | Haygood | |
| D478,525 | S | | 8/2003 | Haygood | |
| 6,815,606 | B1 | | 11/2004 | Chung | |
| 6,943,285 | B2 | | 9/2005 | Chung | |
| 7,078,621 | B1 | * | 7/2006 | Carpenter et al. | 174/51 |

* cited by examiner

Section A

Front View

Bottom View

STATIC ELECTRICITY DISSIPATION DRAIN AND STANDOFFS FOR BY-PASS CONDUCTORS OF FLOATING ROOF TANKS

CROSS REFERENCE TO RELATED APPLICATIONS

This application claims the benefit of provisional patent application, Ser. No. 61/550001 filed Oct. 21, 2011 and 61/684857 filed Aug. 20, 2012, the disclosures of each of which are hereby incorporated by reference herein.

BACKGROUND OF THE INVENTION

1. Field of the Invention

This invention relates to static electricity dissipation drains for dissipating static charges within structures such as storage tanks to minimize a build-up of static electrical potential within the structure that might create an electrical spark within the storage tank.

2. Description of the Background Art

As set forth in my prior patent, U.S. Pat. No. 4,910,636, the disclosure of which is hereby incorporated by reference herein, static electricity dissipators have been used to dissipate electrical charges during a thunderstorm to thereby minimize the likelihood of a lightning strike that might otherwise occur due to the electrical potential between the earth and the atmosphere. My prior static electricity dissipator comprised an electrically-conductive base member having a plurality of fine conductive wires emanating therefrom in a uniform, mushroom-shaped configuration. The tubular base member was typically affixed to roof locations above the structure to be protected such as at locations in which conventional lightning rods would be installed. My static electricity dissipator has achieved substantial commercial success, and has been widely accepted throughout the industry.

U.S. Pat. No. 4,605,814, the disclosure of which is hereby incorporated by reference herein, discloses a lightning deterrent which comprises a cable having a multiplicity of fine conductive wires captured within the strands of the cable to emanate therefrom in a brush-like manner. During use, the cable is formed in a circular or other configuration and mounted about the periphery of the structure to be protected. The terminal ends of the multiplicity of fine conductive wires function to dissipate electrons to the atmosphere, thereby minimizing the electrical potential differential between the structure and the atmosphere. The likelihood of a lightning strike is thereby minimized.

Similar dissipators in which fine conductive wires are captured within the strands of a main cable are disclosed in the following U.S. Patents, the disclosures of each of which are hereby incorporated by reference here.

| Pat. No. | TITLE |
|---|---|
| U.S. 1,757,172 | Aerial |
| U.S. 2,631,189 | Static Wick Discharger |
| U.S. 3,617,805 | Low-Noise Static Discharger Device |
| U.S. 4,180,698 | System and Equipment for Atmospherics Conditioning |
| U.S. 4,605,814 | Lightning Deterrent |
| U.S. 5,638,248 | Static Dissipator |
| U.S. 6,307,149 | Non-Contaminating Lightning Protection System |
| U.S. 6,369,317 | Safer Lightning Rod and Warning System |
| U.S. 6,943,285 | Bipolar Discharge-Dissipation Lightning Air Terminals |
| U.S. D478,294 | Lightning Dissipation Assembly |
| U.S. D478,295 | High Dissipation Discharge Terminal |
| U.S. D478,525 | Point Discharge Dissipation Terminal |

In addition to dissipating static electricity for lightning protection for buildings, it is likewise known that storage tanks, which store a combustible fluid, are in need of lightning protection. Representative patents disclosing lightning dissipators for protection of storage tanks and other structures are disclosed in the following U.S. Patents, the disclosures of each of which are hereby incorporated by reference herein.

| Pat. No. | TITLE |
|---|---|
| 1,617,788 | Device for Preventing Electrical Ignition of Stored Inflammable Fluids |
| 1,743,788 | Apparatus for Treating Flotant Material |
| 1,974,315 | Lightning Protection for Storage Tanks |
| 5,694,286 | Lightning Protection Device |
| 6,815,606 | Bipolar Multi Electrostatic Inducing Discharge-Dissipation Lightning Air Terminals |

More specifically, during filling of a storage tank, particularly one composed of fiberglass or metal lined with insulative dielectric material, it is known that a static charge is created between the fluid inflow droplets and the inner wall of the storage tank. It is also known that as the static electrical potential accumulates, an electrical spark could eventually be created within the storage tank, and could thereby cause the flammable liquid therein to ignite or explode.

Unfortunately, apart from lightning protection, there has been an unsatisfied need for a static electricity dissipator for reducing static electrical potential within the storage tank or other structure itself, particularly when the tank or structure is manufactured of a non-conductive material such as fiberglass (e.g., a fiberglass saltwater disposal (SWD) tanks) or metal lined with an electrically insulative material. Known prior art systems that employ a Carbon Veil, Chains or a Conductive Paint or that consist of a Catenary System or an Early Streamer Emitting System are discussed as follows.

Carbon Veil is a conductive strip woven into a fiberglass tank with a grounding lug provided near the base of the tank. The intent is to dissipate static charge from the stored product onto the strip. The drawback of this system is that it presents a flat surface to, and is not in direct contact with, the stored product. Charge more readily dissipates into a liquid off small radius electrodes than off flat surfaces, limiting the effectiveness of the veil. If adjacent wraps of the veil do not overlap, it presents the possibility of arcing between wraps during a lightning strike or ground fault. The carbon veil does not provide bonding to miscellaneous masses of inductance on the tank. Neither does it provide air terminals (lightning rods) or a full-size conductor to ground.

Chains (or other appliance suspended in tank) are intended to dissipate static charge from the stored product onto the chain or other appliance. The drawback of this system is that it presents a flat (curved) surface to the stored product. Charge more readily dissipates into a liquid off small radius electrodes than off flat surfaces, limiting the effectiveness of the appliance. The chain or other appliance does not provide bonding to miscellaneous masses of inductance on the tank. Neither does it provide air terminals (lightning rods) or a full-size conductor to ground.

Conductive Paints are employed but only to coat the outside of the tank. Therefore, it cannot dissipate static charge from the stored product. Conductive paint may help by providing a path for energy from a direct lightning strike down the tank exterior. However, this division of current over the face of the painted surface is compromised, as there is only one or two ground lugs providing a path to ground at the base of the tank. Additionally, the painted surface will be only marginally effective in serving as a lightning attachment point. If lightning attaches to the tank, the paint will probably not be thick enough to prevent melt-through of the fiberglass, as it does not meet lightning protection code requirements (NFPA 780-3.6.1.3).

A Catenary System consists of grounded masts or poles supporting a wire or wires over the site. This type of system is primarily intended to protect electric power utility company transmission and distribution lines by intercepting what would otherwise be direct strikes to the phase conductors. The overhead wires have no effect on streamer formation from the tanks, and therefore do not affect the likelihood of a direct strike to the tanks They are merely intended to "get in the way" of a direct strike, intercepting and conveying it to ground. When used to protect tanks or other structures, this system cannot mitigate secondary effect arcing, the primary cause of ignition. In fact, if a catenary system performs exactly as designed and intercepts a direct strike, it maximizes the likelihood of secondary effect arcing across the tank and appurtenances by bringing the lightning energy to ground near the base of the tank. The catenary system also has no effect on the static charge on the stored product, does not provide bonding to miscellaneous masses of inductance on the tank, and does not provide purpose-designed air terminals on the tank or tank battery.

An Early Streamer Emitting System uses a small number of air terminals, usually a single air terminal, to protect an extended area. This type of air terminal works by emitting a streamer early in the streamer formation phase of a lightning strike. The streamer will therefore reach the downward reaching stepped leaders before any other, thereby becoming the preferred lightning attachment point. They often are labeled with names inferring that they protect the area by keeping away direct lightning strikes. Actually, the opposite is true. They attract lightning to themselves and to the site. Therefore, lightning will tend to attach to the ESE air terminal rather than to the tanks and other structures. However, lightning attachment is not the primary cause of ignition at the sites. Secondary effect arcing is the primary cause of ignition. As these devices attract lightning to themselves, they actually cause maximum secondary effect current flow right at the site, introducing, not preventing, the primary cause of ignition.

Lightning protection for external floating roof tanks has been the subject of much discussion in recent years. The American Petroleum Institute has recently devoted much time and study to this subject and has promulgated API 545—Lightning Protection for Hydrocarbon Storage Tanks By way of background, a lightning strike consists of two components: a short duration, high-energy spike which is then followed by a longer duration, lower energy tail. While the high-energy spike is impressive, it is the lower energy, long duration component that is actually responsible for ignitions in external floating roof tanks More specifically, the roof of the tank floats on pontoons on the stored product. It is centered in the tank shell by centering shoes. Vapor is contained by a primary and a secondary seal. These tanks have traditionally been equipped with flexible, stainless steel grounding shunts spaced at frequent intervals around the perimeter of the floating roof. Additionally, the floating roof is usually bonded to the tank shell with one grounding conductor run along the stairway from the top of the tank shell to the floating roof Lightning becomes an issue when it strikes either the floating roof, the tank shell, or nearby. Ignition is not normally caused by the heat of the lightning channel igniting venting vapors. It is caused by arcing from the secondary effect of lightning. A thunderstorm is an electrically charged cloud mass, with a charge, usually negative, at its base. That charge induces an opposite charge, usually positive, on the surface of the earth beneath it. When lightning attaches to a tank or other object on the surface of the earth, the charge at the point of attachment changes dramatically and almost instantly. The surrounding ground charge rushes toward the point of the strike. If that in-rush of charge crosses a gap, it may arc. If that gap is between the floating roof and the side of the tank shell, and there are flammable vapors present, those vapors may ignite.

Another way of looking at this phenomena is to consider a lightning attachment to the shell of the tank. The tank shell changes potential almost instantly. The floating roof, being somewhat electrically isolated from the shell, does not. That difference in potential between the floating roof and the tank shell must equalize. Unless a preferred path is provided, a potential equalizing arc may occur, once again igniting any flammable vapors present.

Presently, most external floating roof tanks are equipped with flexible stainless steel grounding shunts around the perimeter of the floating roof. These shunts are attached to the roof, and bent upward and outward to press against the tank shell wall. They ride against the tank shell wall, up and down as the roof rises and falls. The electrical contact to the wall is adequate only when the tank is new and the wall is clean. After a few trips up and down, the tank wall becomes coated with a variety of substances that compromise the electrical bond. Because of the short length and frequent spacing of these shunts, they are the preferred path of equalization between the floating roof and tank shell for the high-energy short duration component of the lightning strike. API 545 recommends employing these shunts for this purpose. However, because of the contaminants on the tank wall, these shunts tend to emit a shower of sparks when they perform their intended function. One solution suggested by 545 is to relocate these shunts so they are submerged under the stored product and there is no oxygen available at the source of the sparks to support ignition. However, submerging the shunts creates other problems when the roof is landed.

Further, to address the lower energy, long duration component of the lightning strike, API 545 recommends the installation of by-pass conductors between the floating roof and tank shell at intervals not to exceed 100' around the roof perimeter. These conductors provide a low-resistance bonding path between the roof and tank shell, and are intended to prevent ignition-causing arcs generated by this current flow.

In summary, by-pass conductors address the lower-energy longer duration component of the lightning discharge and simply attaching a length of conductor from the edge of the floating roof to the top of the tank shell is adequate. Unfortunately, however, the by-pass bonding conductors must be kept out of the way as the floating roof rises and falls. One embodiment comprised a grounding reel similar to that used to bond a fuel truck to an airplane. This grounding reel employed a flat, braided, tinned copper strap. The strap offered lower surge impedance than a round conductor, and, as the strap retracted into the reel, it was pressed against the inner windings of strap, effectively shortening the overall length of the conductor. Unfortunately, grounding reels were of questionable durability and were costly.

Accordingly, there presently exists a need for a static electricity dissipator drain for use inside a structure such as a storage tank to dissipate the static electrical potential that may accumulate therein and otherwise create an electrical spark in the structure.

Therefore, it is an object of this invention to provide an improvement which overcomes the aforementioned inadequacies of the prior art devices and provides an improvement which is a significant contribution to the advancement of the static electricity dissipator art.

Another object of this invention is to provide a static electricity dissipation drain for storage tanks having a fixed roof or a floating roof.

Yet another object of this invention is to provide a static electricity dissipation drain for storage tanks composed of metal, fiberglass, plastic or lined metal.

Another object of this invention is to provide a static electricity dissipation drain for storage tanks to bond the stored product and suspended droplets in the vapor space to the bonded mass of the tank.

Another object of this invention is to provide a static electricity dissipation drain for storage tanks to dissipate the static charge in the stored product and suspended droplets in the vapor space, preventing it from building to an incendive level.

Another object of this invention is to provide by-pass conductors from the edge of the floating roof to the top of the tank shell to address the lower-energy longer duration component of the lightning discharge that is kept out of the way as the floating roof rises and falls.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a static electricity dissipator drain for use within a storage structure, such as a storage tank, to minimize the build-up of static electrical potential between the product being stored and the structure itself, thereby minimizing the likelihood of an electrical arc within the structure.

More particularly, the static electricity dissipation drain of the invention is particularly suitable for use in process vessels such as within a series of salt water separation tanks manufactured of metal, a non-conductive materials such as fiberglass or of a conductive material lined with a non-conductive material for separating petroleum from water after being pumped from the ground, whereupon the petroleum may be separated and the water, commonly salt water, injected back into the ground or otherwise disposed of Other applications include other production, flow back and process tanks, storage grain elevators and storage tanks (conductive or non-conductive) for storing petroleum and other fluids and for storing particulate matter such as plastic pellets used for injection molding. It should be appreciated, however, that the static electricity dissipation drain of the invention may be used in connection with many other applications in which products are stored and where a build-up of static electricity causing arcing may occur within the storage tank, vessel or other structure. Indeed, it is again emphasized that, without departing from the spirit and scope of the invention, the static electricity dissipation drain of the invention is intended to be used in conductive as well as non-conductive structures that are filled with conductive and/or non-conductive materials. Finally, while the static electricity dissipation drain of the invention has particular application to reduce static electricity build-up within the tank during filling of the tank, it likewise has the beneficial effect of protecting the structure from internal arcing that might otherwise occur upon build-up of the ambient ground charge that would naturally occur in the event of a nearby lightning strike that would increase the electrical potential inside of the tank.

The best mode for implementing the invention solves the problem of ignition in hydrocarbon storage tanks caused by static and lightning and takes into account the four conditions that are necessary to allow ignition: (1) the creation of static charge, (2) that builds to an incendive level containing enough energy to cause ignition, (3) a source of ignition (arcing) and (4) a flammable mixture in the tank. These conditions are discussed as follows.

(1) A static charge is created by normal tank operations (filling and emptying). Moving a stream of liquid through standing liquid strips ions, thereby creating a charge. Also, secondary effect from a direct or nearby lightning strike has the same effect. There is little that can be done to mitigate this condition.

(2) Charge dissipates from the liquid in the tank onto points and edges. Even if the liquid is in a steel tank, the charge cannot dissipate into the steel, but must inductively couple. That takes time, allowing the charge to build more quickly than it dissipates. This condition is most likely as filling of the empty tank is commenced. Most tanks are splash-filled. In the case of salt water separation/disposal (SWD) tanks, splash filling is desired to break the liquid into smaller particles, enhancing separation. It also enhances the creation of static charge. Also, secondary effect from a direct or nearby lightning strike creates a charge much more quickly than it can couple. Either mechanism can allow the charge to build to an incendive level. This is one condition that is addressed by the subject invention.

(3) Sources of ignition include masses of inductance (large metal masses) on or near the tank, including valves, piping, hatches, walkways, metering or gauging equipment, etc. Due to loosened connection between the masses, rattling between the masses and hence arcing may occur. This is another condition addressed by the subject invention because when the subject invention is installed on non-conductive tanks, all the masses are bonded together electrically with conductors, including bonding the thief hatch cover to its collar.

(4) Drainage or emptying a tank (and certain servicing operations such as cleaning residue in the bottom of the tank) draws in ambient air to keep the tank from collapsing, allowing sufficient oxygen into the tank to create a flammable mixture. There is little that can be done to mitigate this condition.

As described below in the Detailed Description of the Preferred Embodiment, the present invention addressed the potential conditions that are necessary to allow ignition by controlling conditions (2) and (3).

More particularly, the present invention serves to bond the stored product and suspended droplets in the vapor space to the bonded mass of the tank, and to dissipate the static charge in the stored product and suspended droplets in the vapor space, preventing it from building to an incendive level.

On non-conductive (fiberglass, plastic, etc.) tanks, the static electricity dissipator drain is bonded to metal masses (masses of inductance) on the tank, particularly at the top of the tank where such metal masses (e.g., hatches, covers, caps and other metal components) are not bonded through the stored liquid product. The stored liquid product, being at least semi-conductive, bonds any pipes, valves and other metal components at the base of the tank because they are submerged or semi-submerged in the liquid. Static charges can be equalized over high resistance, so the liquid is sufficiently conductive to equalize charges between metal masses it covers or touches. At the top of the tank, however, without implementing the subject invention the masses are not sufficiently bonded to equalize static charge, allowing an arc between the static charge on the suspended droplets in the vapor space above the stored product and a valve, hatch, or other conductive device.

On a metal tank, no bonding conductors other than across hinged hatches are necessary, as the metal masses are bonded through the tank structure. Pipe dope and joint tape do not necessarily compromise this bond, as there is at least some metal-to-metal contact.

This invention also comprises a non-conductive tubular standoff for by-pass conductors of floating roof tanks The standoff attaches mechanically and electrically to the perimeter of almost any type of floating roof by means of a unidirectional pivotal bracket. A by-pass conductor extends through the tubular standoff and is then mechanically and electrically attached to the upper edge of the tank by means of a rim bracket.

The unidirectional bracket allows the tubular standoff to be "aimed" to miss tank appurtenances that may otherwise foul the by-pass conductor. Guide wires may be provided as needed to more accurately aim the tubular standoff to miss tank appurtenances as the tubular standoff lays down onto the top of the floating roof. The rim bracket includes an arcuate channel that supports the by-pass conductor, defines its bending radius from the top of the tank and further assists the by-pass conductor from fouling on tank appurtenances. Likewise, the uppermost end of the standoff includes an arcuate channel that defines the bending radius of the by-pass conductor as it exists the tubular portion of the standoff.

Preferably, the tube of the tubular standoff encloses and supports the by-pass conductor for slightly under half its length. Also preferably, the tube of the tubular standoff comprises a lightweight non-conductive construction such as fiberglass or Kevlar.

In another embodiment in lieu of the tubular standoff, the invention comprises a helical by-pass conductor having a natural twist that is connected at one end to the upper rim of the tank by the rim bracket and at another end to the floating roof. The natural twist of the by-pass conductor urges the by-pass conductor into a coiled mass on top of the floating roof as the roof raises. However, according to the present invention, a plurality of spherical separators are fastened along the length of the by-pass conductor to assure that the coils do not become entangled as they lay down onto or played out from the floating roof and to assure that no part of the by-pass conductor becomes trapped or pinched in the joint between the outer periphery of the floating roof and the tank wall as the by-pass conductor as the by-pass conductor lays down onto or is played out from the floating roof.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
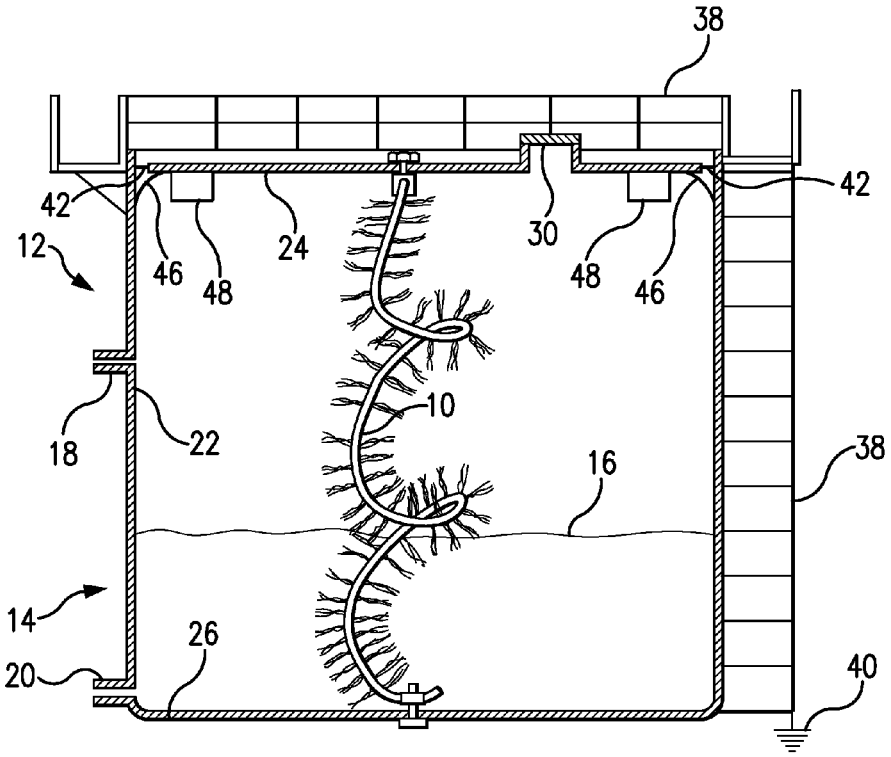
FIG. 1 is a diagrammatic view of the static electricity dissipation drain of the invention showing the manner in which it is installed within a structure such as a storage tank.

Referring to FIG. 1, the static electricity dissipator drain 10 of the invention is intended to be installed within a structure 12 such as a storage tank 14 to dissipate the build-up of static electricity within the tank 14 as the product is filled with product 16 via inlet 18 or emptied via outlet 20.

More particularly, conventional storage tanks 14 comprise a generally cylindrical configuration composed of a side wall 22 covered by a top wall 24 and supported by a bottom wall 26. In some storage tanks 14, the top wall 24 is fixed whereas in other storage tanks 14, the top wall 24 floats upon the fluid product 16 to move upwardly upon filling the tank via inlet 18 or to slide downwardly upon emptying the tank via outlet 20.

Without departing from the spirit and scope of the invention, the tank 14 may alternatively comprise barges and ships that have internal tanks for the storage of flammable or explosive material.

The standing end of the static electricity dissipator drain 10 of the invention is preferably suspended from the top wall 24. As shown in FIG. 1, in floating-roof tanks, the trailing end of the static electricity drain 10 may then be connected to either the side wall 22 or bottom wall 26 of the storage tank 14 so as to move upwardly during filling or downwardly during emptying of the tank, with the trailing end remaining submerged.

Figure 2A:
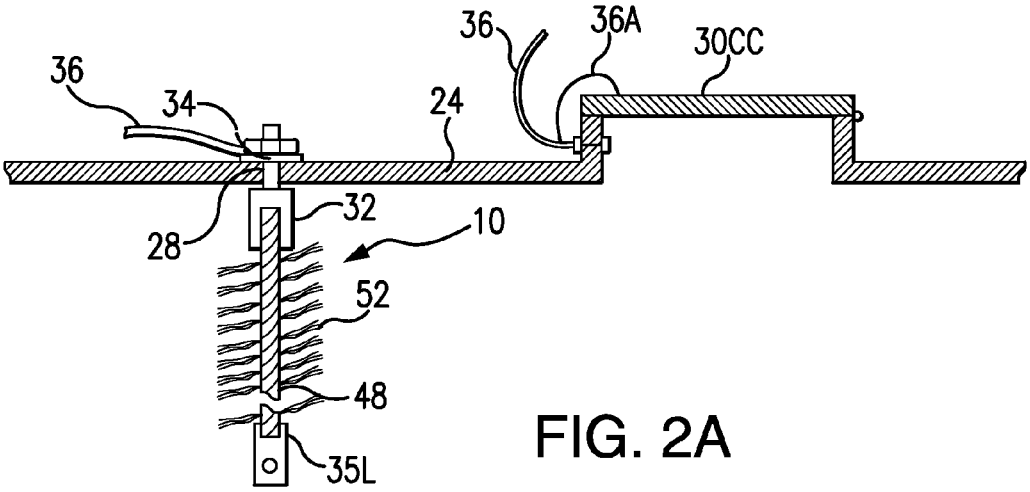
FIG. 2A is a partial cross-sectional view of one manner in which the static electricity dissipation drain of the invention is mounted from the underside of the top of the storage tank via its thief-access hatch.

As shown in FIG. 2A, the static electricity dissipator drain 10 of the invention may be installed in the underside of the top wall 24 of the storage tank 14 by simply drilling a hole 28 through the top wall 24 within a reachable distance from the thief-access hatch 30. Upon opening of the thief-access hatch 30, the static electricity dissipator drain 10 may be fed therethrough with its upper portion grasped by the installer and then inserted upwardly through the hole 28 drilled in the top wall 24. As shown, the upper end of the drain 10 comprises a threaded boss 32 (into which the drain 10 is crimped) for receiving a washer and threaded nut 34 once it is inserted back through the hole 28 in the top wall 24. The lower end of the drain 10 may be clamped to the bottom or side wall of the tank as shown in FIG. 1 by an end connector 35L crimped onto the lower end of the drain 10, or simply be left dangling. Notably, the natural helical lay of the drain 10 allows the drain 10 to fold as the top wall 24 moves upwardly or downwardly with respect to the bottom wall 22.

Figure 2B:
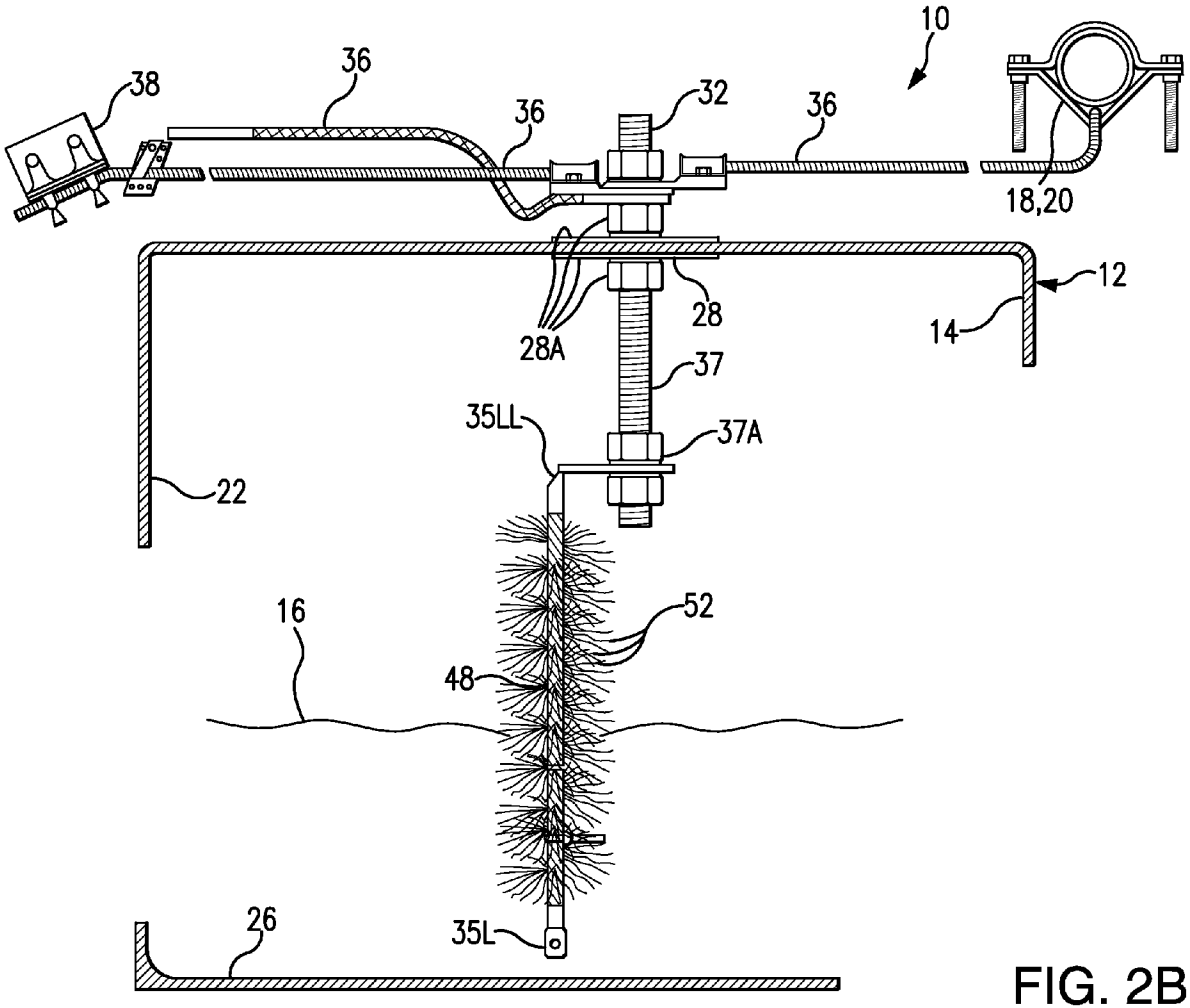
FIG. 2B is a partial cross-sectional view of another manner in which the static dissipation drain of the invention is mounted to a threaded rod to then be mounted from the underside of the top of the storage tank.

As shown in FIG. 2B, an alternative embodiment for installing the static electricity drain 10 to the underside of the top wall 24. Specifically, an end connector 35U crimped onto the upper end of the drain 10 and bent at a 90° angle. The connector 35U is fastened to a threaded length of rod 37 by opposing nuts and washers 37A. The rod 37 is inserted into the holes 28 and secured by opposing nuts and washers 28A. The end connector 35L of the static electricity drain 10 may be sufficiently long to dangle in the storage tank 14 on or just above its bottom wall 26 or may be long enough to extend all the way to its bottom wall 26 and connected thereto as described in connection with the embodiment of FIG. 2A.

Figure 2C:
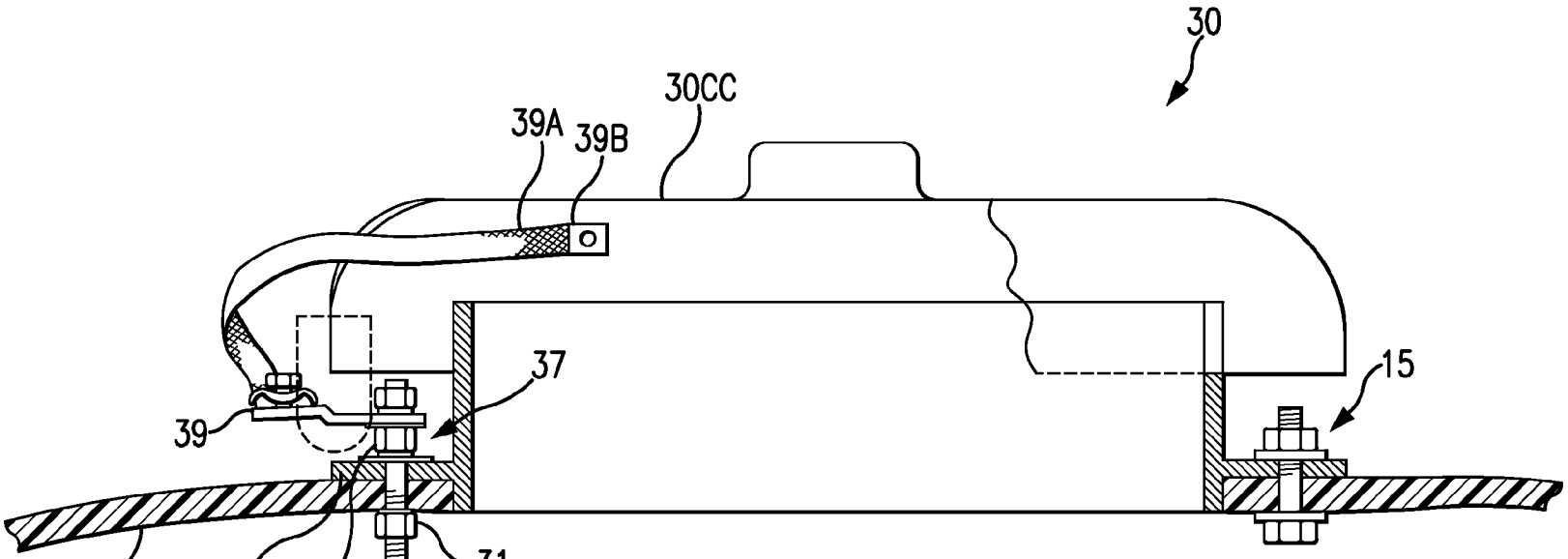
FIGS. 2C, 2D and 2E are partial cross-sectional views of another manner in which the static dissipation drain of the invention is mounted to a threaded bolt of a thief hatch of the storage tank and then to the cover of the thief hatch.
Figure 2D:
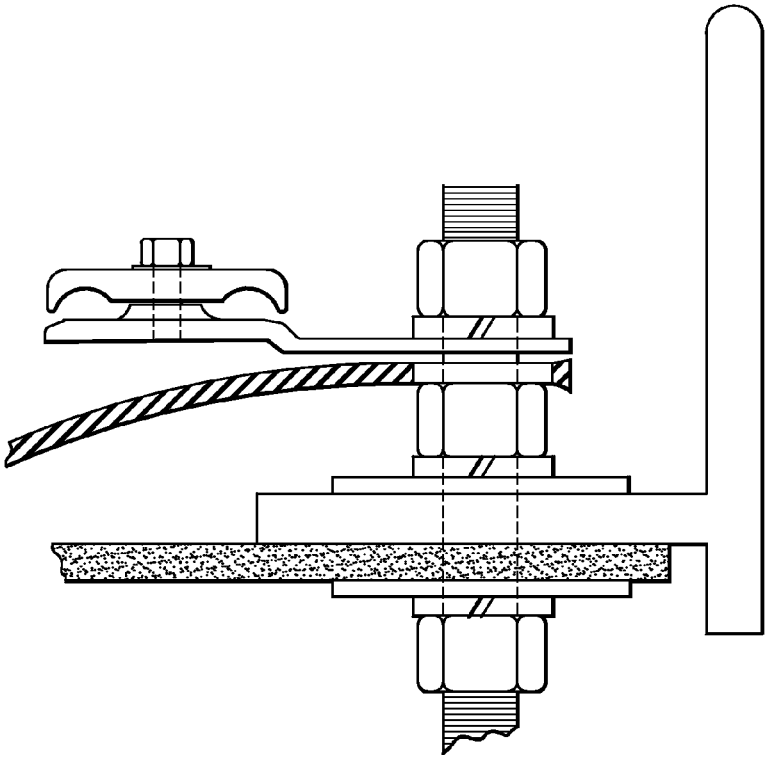

As shown in FIGS. 2C, D and E, the static electricity dissipator drain 10 of the invention is preferably installed by via one of the mounting bolts 15 of the collar 30C of the thief hatch 30. More specifically, upon opening of the cover 30CC of the thief hatch 30, one of its mounting bolts 15 may be removed, and discarded. The static electricity dissipator drain 10 is then installed in a similar manner to that described above in connection with FIG. 2B with the rod 37 taking the place of the mounting bolt 15. Note that the rod 37 is secured into position by a pair of opposing nuts and washers 31. As noted above, the lower end of the drain 10 may be clamped to the bottom or side wall of the tank as shown in FIG. 1 by an end connector 35L crimped onto the lower end of the drain 10, or simply be left dangling in contact with or slightly above the tank bottom.

As also shown in FIGS. 2C, D and E, the thief hatch collar 30C and the thief hatch cover 30CC are electrically grounded together by a flexible electrically conductive jumper 36A having one end connected to a metal bracket 39 mounting onto the end of the metal rod 37 by another nut and washer 33 and the other end connected to the thief cover 30CC by a crimped-on end connector 35LL electrically connected to the thief cover 30CC by a metal bolt and nut 30B mounted through a drilled hole in the thief cover 30CC.

As also shown in FIGS. 1 and 2A and 2B, the upper end 32 of the drain 10 may be connected via an electrical ground 36 to a catwalk and steps 38 surrounding the tank 14 which is itself electrically connected to earth ground via a ground electrode 40. The electrical ground 36 may also be connected to the inlet 18 and outlet 20.

Figure 3:
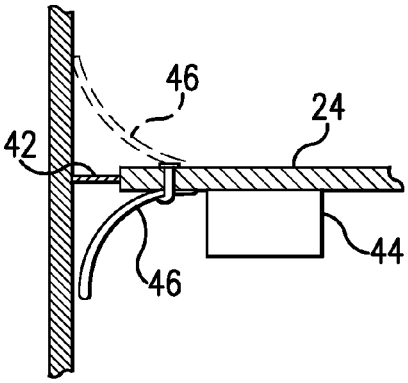
FIG. 3 is a partial cross-sectional view of a floating top of a storage tank and the manner in which the top is sealed along the inner lumen of the storage tank as it slides upwardly during filling or downwardly during emptying.
Figure 4:
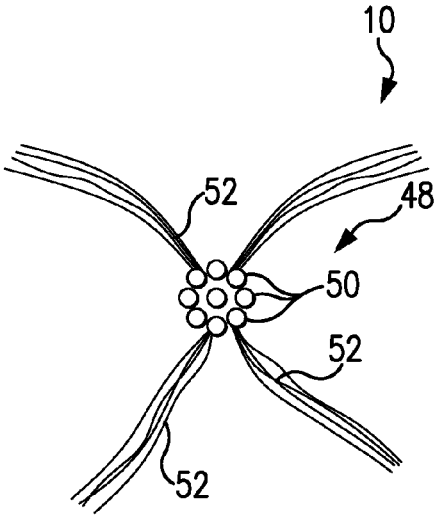
FIG. 4 is a cross-sectional view of the cable in which the fine wires are entrained during manufacturing of the static electricity dissipation drain of the invention.

When used in conjunction with a floating top wall 24, as shown in FIG. 3, it is noted that the top wall 24 is sealed against the lumen of the side wall 22 by means of an annular seal 42 formed about the annular periphery of the top wall 24. It is also noted that conventionally the top wall 24 is composed of a material that would not otherwise float on the surface of the product contained within the tank 14 and, therefore, conventionally a pontoon 44 is affixed to the underside of the top wall 24 to provide the needed buoyancy. Conventionally, an annular deflector 46 is affixed to the top periphery of the top wall 24 to slide up and down the lumen of the side wall 22 to deflect dirt, precipitation, snow and other possible contaminants away from the annular seal 42. However, it is noted that the deflector 46 traps vapors flowing from the product 16 contained within the tank 14 and thereby potentially creates an explosive environment.

Figure 2E:
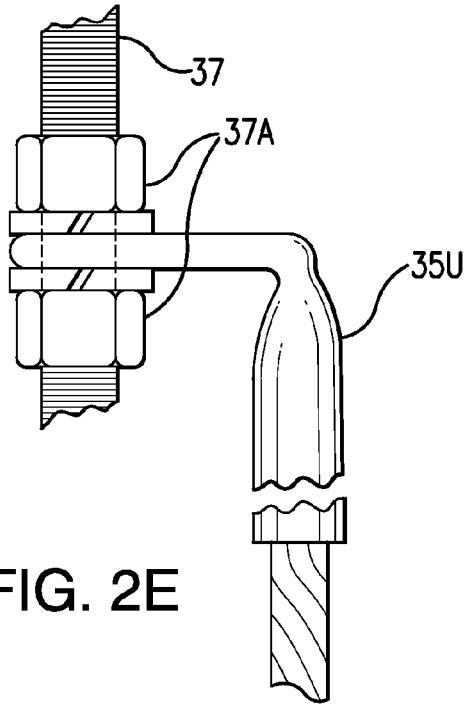

As shown in FIGS. 2A and 2E, the static electricity dissipation drain 10 of the invention is preferably manufactured from a length of cable 48 whose upper end is crimped in the boss 32 or connector 35U. The strands of cable wires 50 may be unfurled from the balance of the cable 48, whereupon a multitude of very fine dissipator wires 52 may be laid into the remaining strands 52. The removed strands 50 can then be refurled onto the cable 48 to securely retain the dissipator wires 52 to fully entrain the dissipator wires 52 within the cable. It should be appreciated, however, that other embodiments of a dissipator may suffice without departing from the spirit and scope of the invention.

Figure 5:
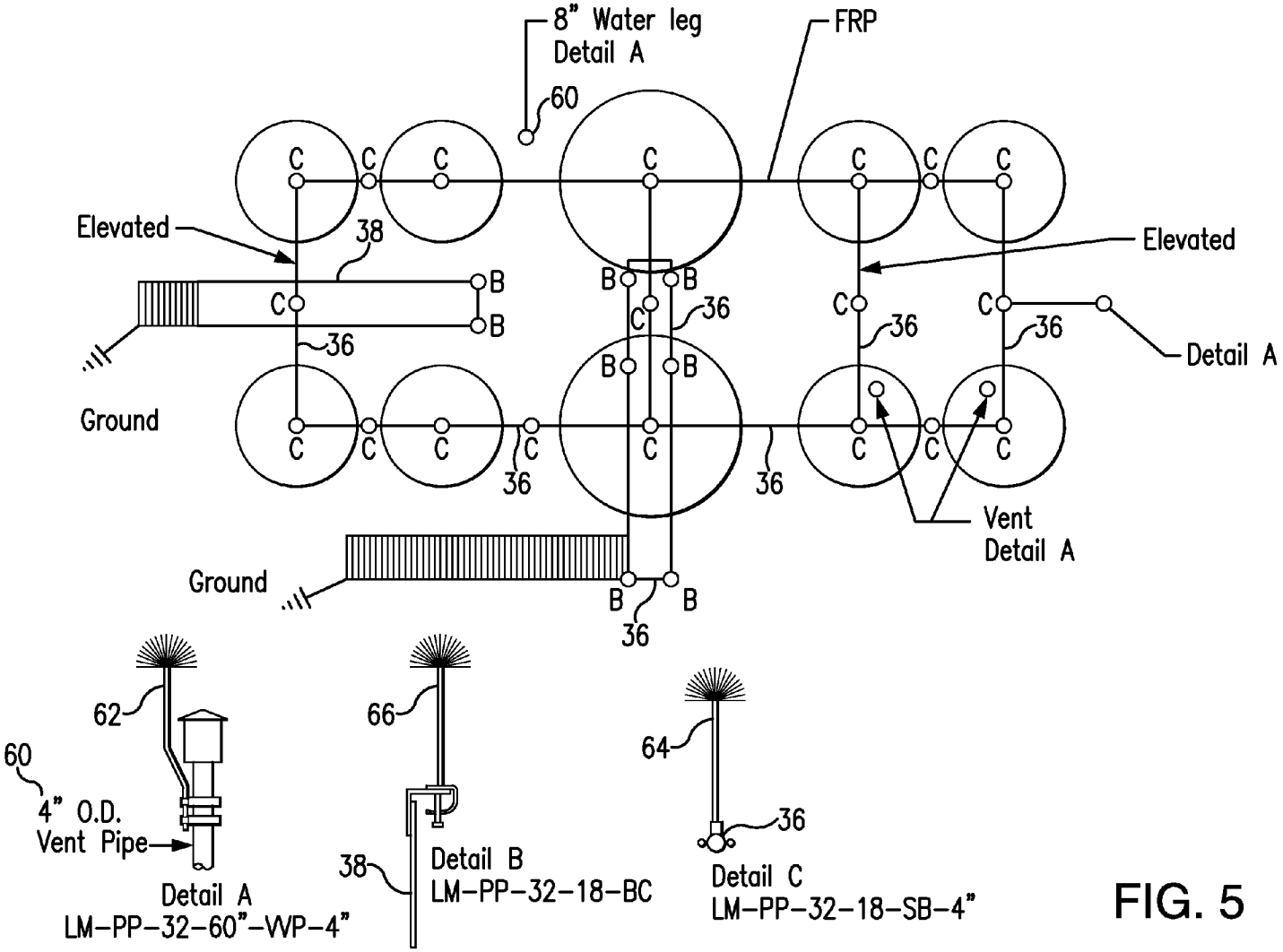
FIG. 5 is a schematic wiring diagram showing the grounding of a typical tank battery having a plurality of tanks used for separation of saltwater from oil pumped from the ground.

Referring to FIG. 5, the present invention substantially reduces or eliminates altogether the conditions (2) and (3) noted above that might otherwise result in combustion in or around the tank battery.

More particularly, in the case of non-conductive (fiberglass) tanks 12, all of the metallic masses are bonded electrically with a bonding conductor 36. The bonding conductor 36 is bonded to the vent pipe 60 (the actual connection to the tank is usually metal) or the vent pipe manifold (if metal pipe is used) on top of the tank 12 (see Detail A), which is in turn bonded to any other metal masses associated with piping atop the tank 12. It is noted that if plastic piping is used, conductors must be run along the piping to complete the necessary electrical bonding.

As shown in FIGS. 1 and 2A, the bonding conductor 36 is then run to the metal walkway 38 such that the metal walkway, supports and stairs (collectively 38) are employed as an integral component of the bonding conductor system. At the base of the tank, the bonding conductor is connected to the drain pipes and, if installed, the carbon veil. The bonding conductor is then run to the truck loadout provisions or injection well, using conductive product piping if available, or with conductor, if the piping is non-conductive. This eliminates any source of arcing. It also bonds the vacuum trucks, piping, injection well loading water or oil to the system, thereby eliminating another potential problem area.

As noted above, the in-tank static drain 10 is installed in each tank 12. Preferably the drain is sized to be approximately equal to the height of the tank 12 is tall. A connector is preferably installed at the bottom end of the static drain 10 (mostly to keep it from unraveling) and it just hangs in the tank 12. The length is preferably short enough that it will not become fouled in valves or other tank appliances. It must be mechanically secured to the top of the tank, either through a purpose-drilled hole, or through an existing hole (preferably the bolt in the thief hatch collar is replaced with the stud atop the static drain). It is then bonded electrically to the conductor system described above. This brings the stored product in the tank to the same potential as the remainder of the site.

It is noted that when installed in flow-back tanks 12 wherein the fluid is injected at a high volume or velocity, both ends of the drain 10 are preferably secured to prevent too much whipping around of the end of the drain 10 as the tank 12 is filled, with one end bonded to the filler pipe or support gussett. In the case of conductive, fixed roof tanks, the tank steel provides all on-tank bonding, except for the thief hatch flexible jumper, which is installed as noted above. At the base of the tank, conductors on non-conductive piping are installed, bonding the truck loadouts or injection well. Again, an in-tank static drain 10 is installed in each tank 12 as described above to bring the stored product to the same potential as the remainder of the site. Notably, drain 10 is also electrically connected to the metal catwalk surrounding the tank farm, which is in turn electrically connected to earth ground, to function as a grounding buss for the entire system.

In the case of floating roof tanks, bonding is provided by the manufacturer in the form of shunts between the floating roof and tank shell wall. The most recent edition of API 545, Lightning Protection for Hydrocarbon Storage Tanks, will requires additional bonding in the form of conductors between the floating roof and tank shell wall installed at intervals not to exceed 100'. In-tank static drains are installed as these conductors. In this case, the drain must be approximately 20% longer than the height of the tank, and must be secured to both the floating roof and either the bottom of the tank or the side near the bottom in such a manner that it will not interfere with tank operations or maintenance.

To incorporate structural lightning protection into the system, air terminals (lightning rods) of the streamer-delaying type (see dissapators 62, 64 and 66 of Details A, B and C) atop the tank or tank battery and associated walkway handrails. Air terminal layout should meet the requirements of NFPA 780 (the US lightning protection standard).

In order to provide a convenient means for electrical bonding of the air dissapators 62, 64 and 66 and the bonding conductors 26, specially configured grounding clamps 100 and 120 of FIGS. 6 and 7 may be employed.

Figure 6B:
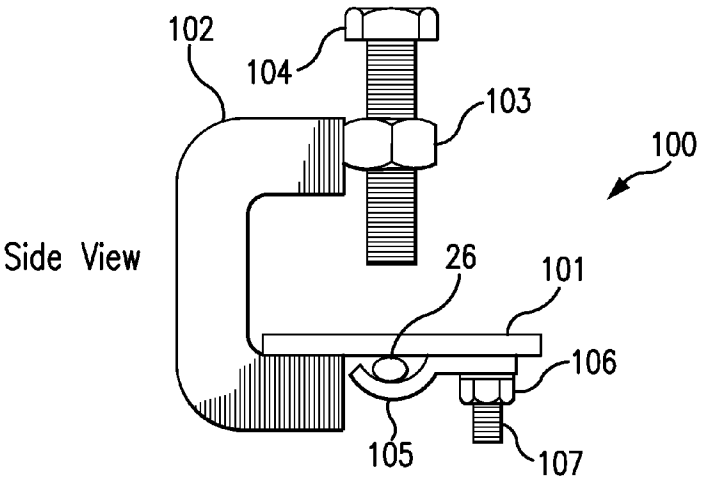
FIGS. 6A, 6B and 6C are perspective, side and top views of a grounding clamp used for electrically connecting the electrical ground to the catwalk and steps.
Figure 6C:
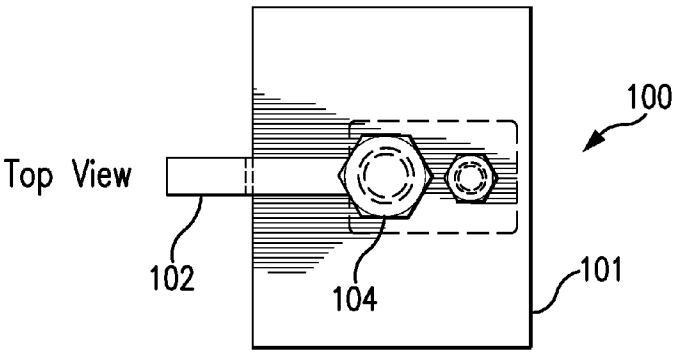
Figure 6A:
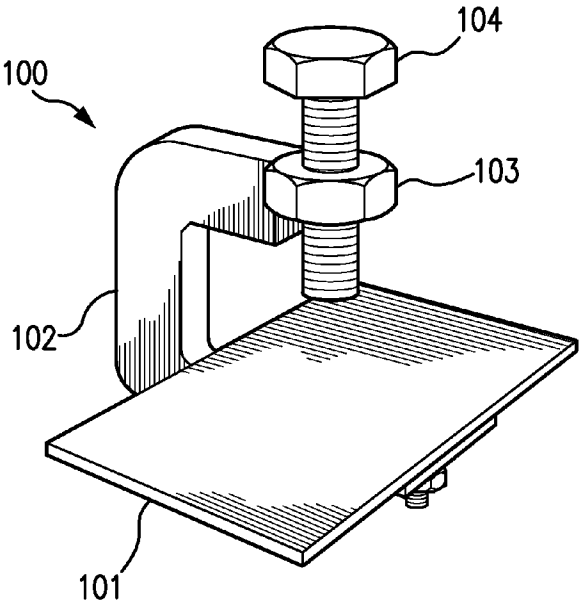

More specifically, the grounding clamp 100 of FIGS. 6A, 6B and 6C comprises a metal base plate 101 to which is welded one end of a generally U-shaped metal arbor 102. A metal nut 103 is welded to the other end of the arbor member 102 in alignment with the base plate 101. A bolt 104 may then be threaded through the nut 103 to clamp the structure being clamped between the base plate 101 and the end of the bolt 104. A cable bracket 105 is mounted to the underside of the base plate 101 by means of a nut 106 mounted onto another bolt 107 welded to the underside of the base plate 101, thereby allowing the bonding conductor 26 to be electrically and mechanically fastened to the clamp 100. It is noted that this clamp 100 is particularly suited for electrically and mechanically connecting the bonding conductor 26 to various "flat" components of the catwalk and steps 38.

Figure 7B:
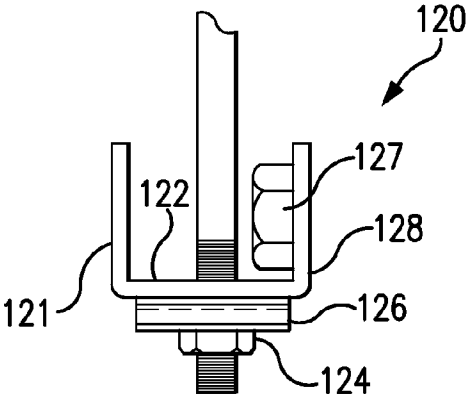
FIGS. 7A, 7B and 7C are front, section and bottom views of a grounding clamp used for electrically connecting the electrical ground to vent pipes and other circular cylindrical structures.
Figure 7A:
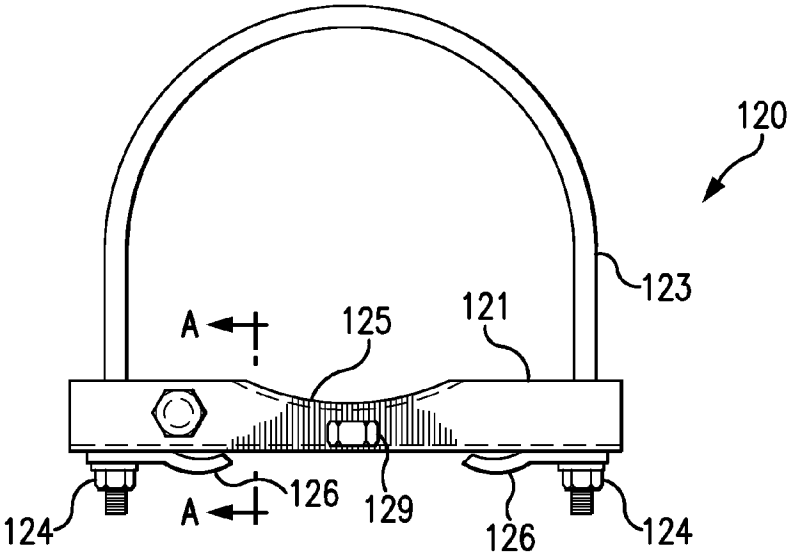
Figure 7C:
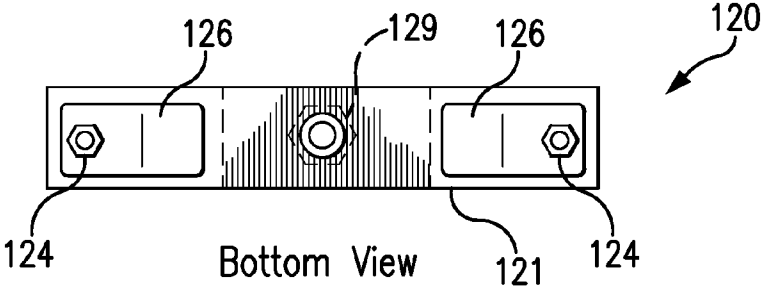
Figure 8A:
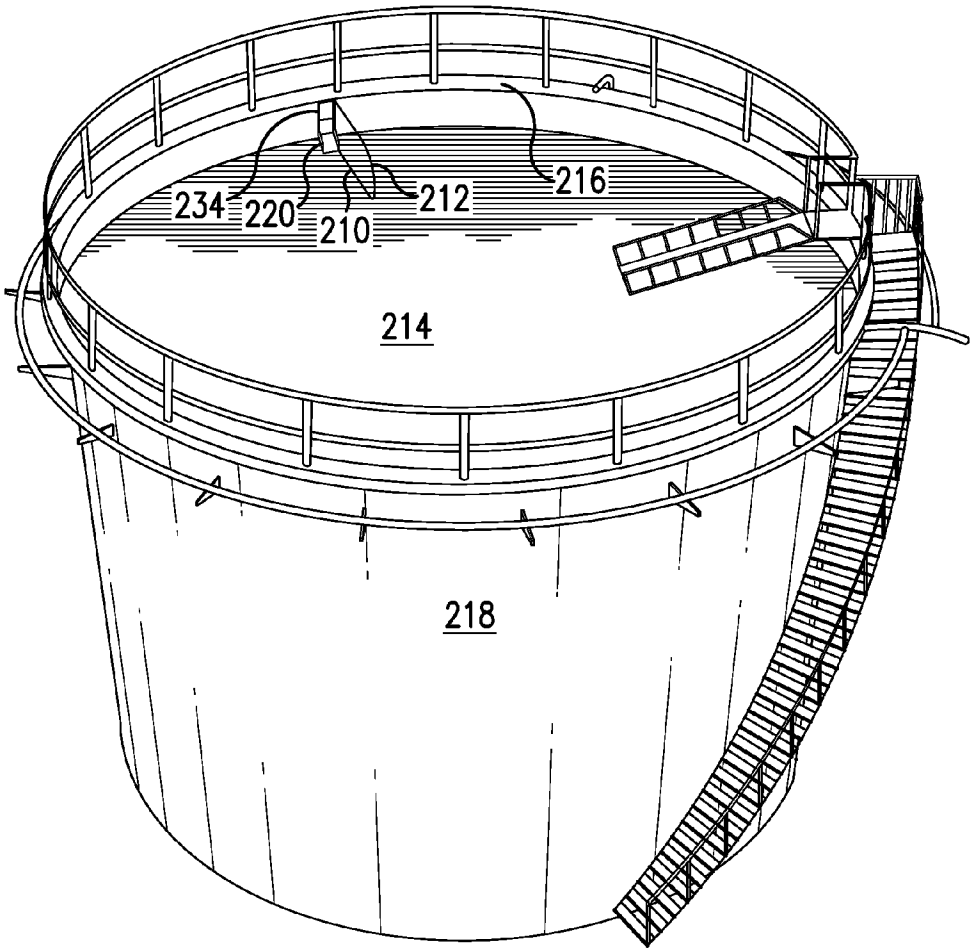
FIGS. 8A-D are perspective views at various tank levels showing the tubular standoff of the invention attached to the floating roof of the tank by means of the unidirectional bracket and showing the by-pass conductor extending therefrom connected to the upper edge of the tank by means of the rim bracket.
Figure 8B:
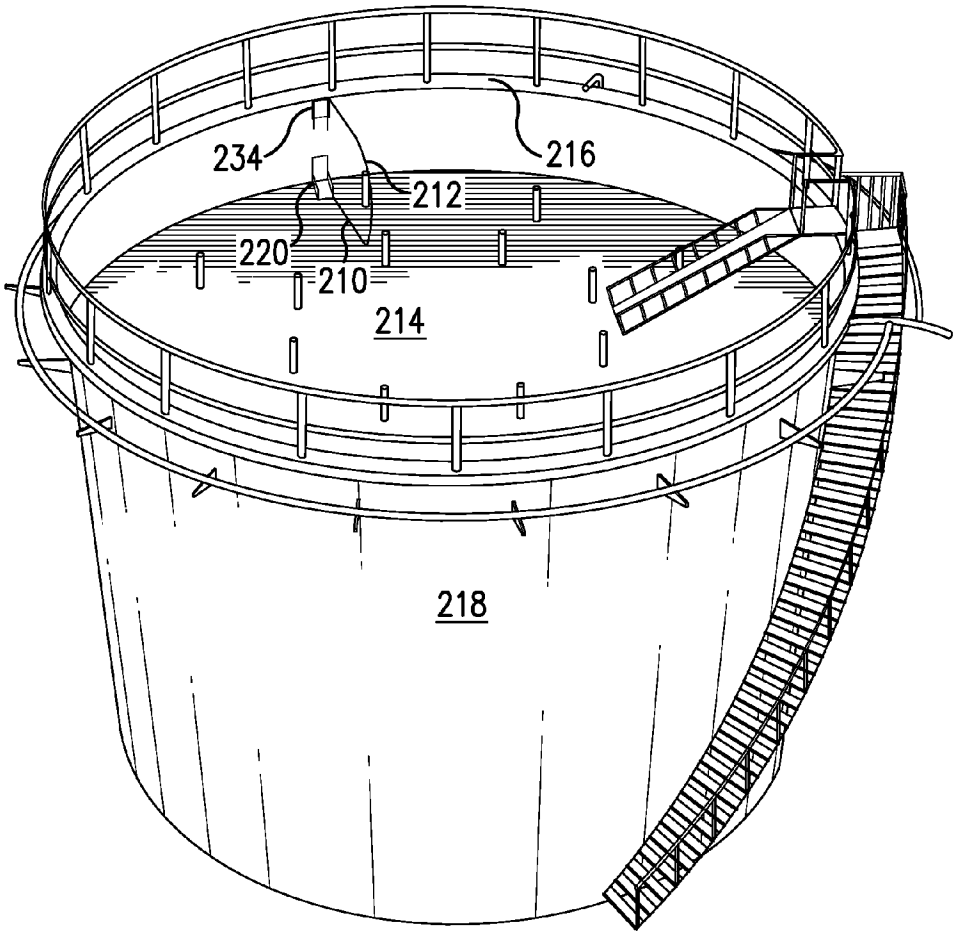
Figure 8C:
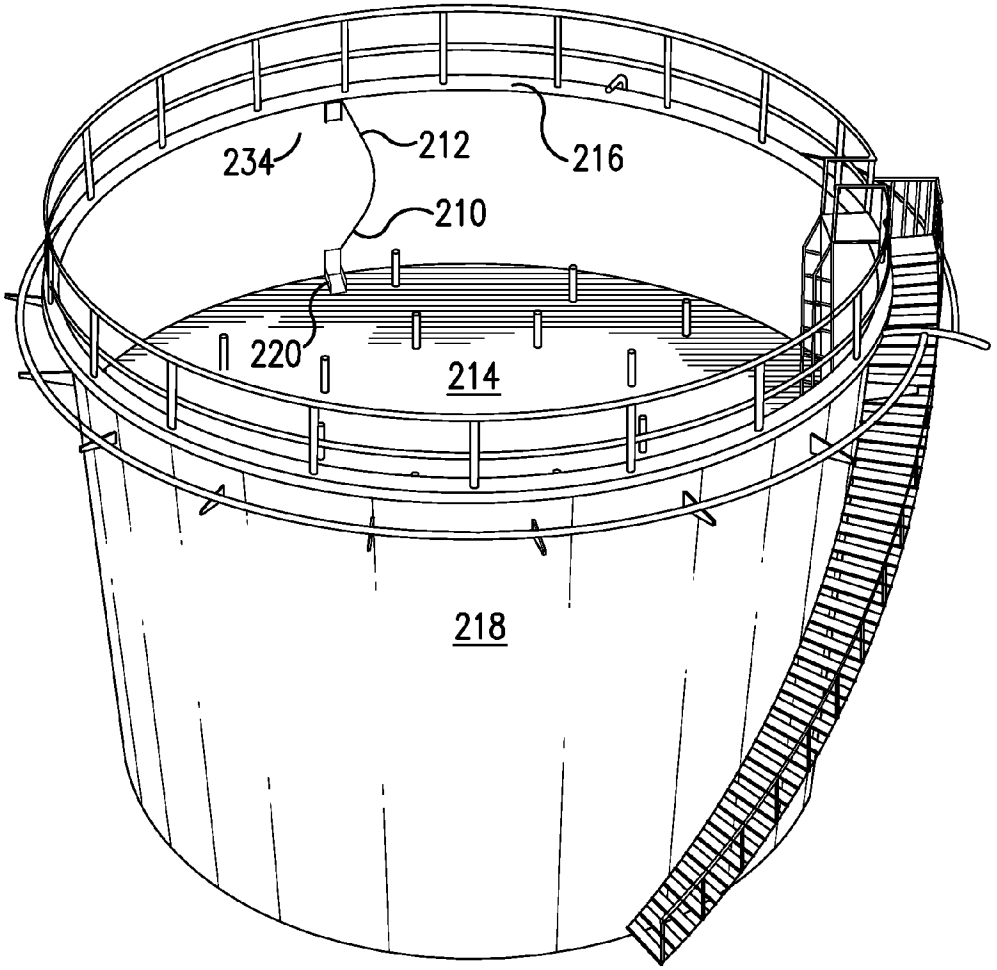
Figure 8D:
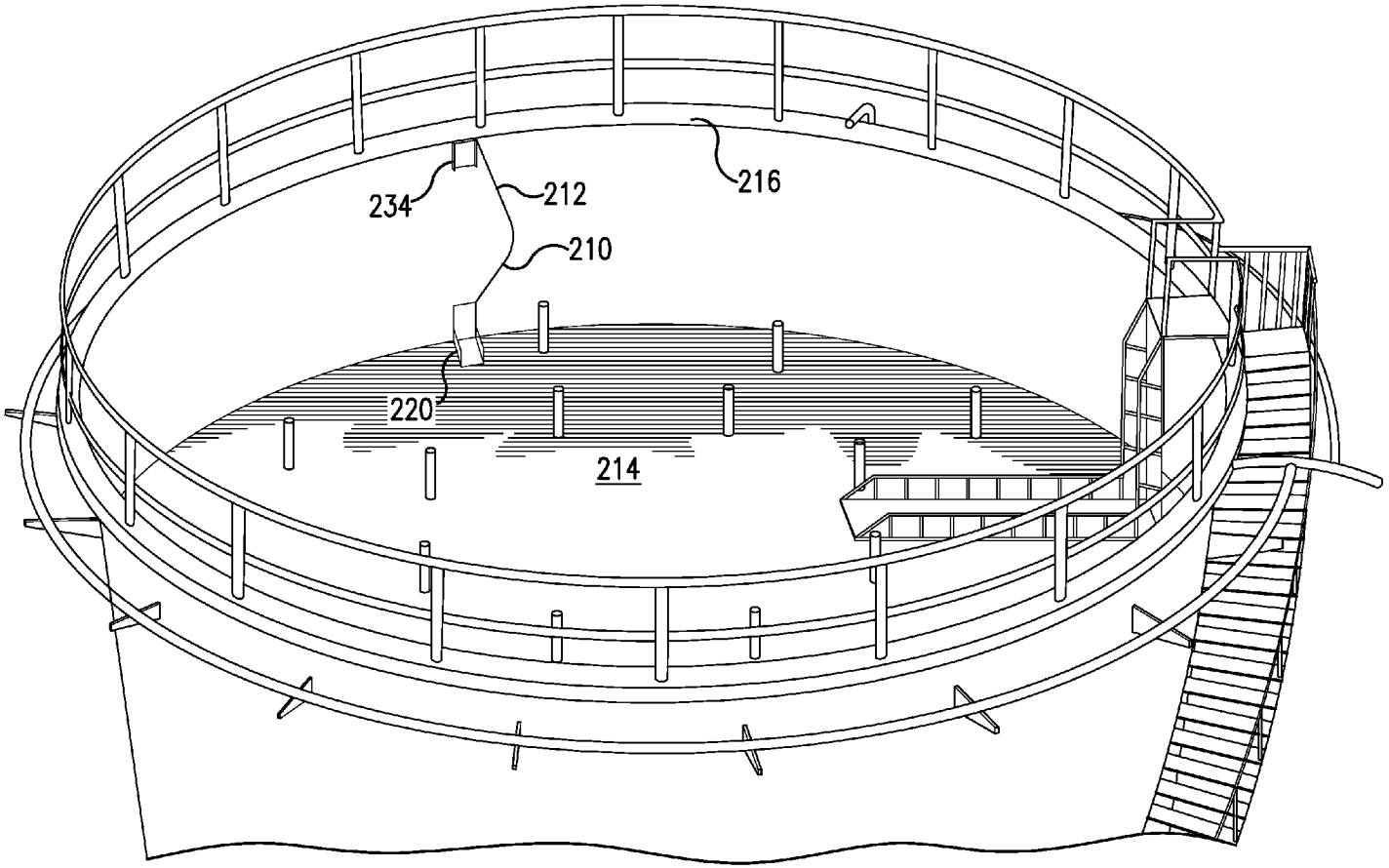

The grounding clamp 120 of FIGS. 7A, 7B and 7C comprises a generally U-shaped channel 121 having opposing holes 122 positioned therethrough for receiving the opposing threaded ends of a C-clamp 123. Nuts 124 threaded onto the opposing ends of the C-clamp 123 allowing it to be electrically and mechanically clamped onto generally circular cylindrical objects such as fill and vent pipes 60. The sides of the generally U-shaped channel 121 may include arcuate cut-outs 125 for a tighter fit around the vent pipe 60. To facilitate easy grounding by the bonding conductor 26, the opposing ends of the C-clamp 123 each includes a cable bracket 126 held into position by the nuts 124.

Additionally, to facilitate connection of air terminals, the clamp 120 includes a threaded nut 127 welded to the inside surface of one side of the U-shaped channel 121 about a hole 128 and another threaded nut 129 welded to the inside bottom surface of the U-shaped channel 121 about a another hole 130. It is noted that the resulting angles are at 90 degrees so that the air terminal may be positioned vertically irrespective of the orientation of the clamp 120 itself by simply installing the air terminal in to the appropriate nut 127 or 129 that is vertically oriented.

Earth grounding may be provided for by the inherent self-grounding of steel tanks connected to the battery, driven ground rods (particularly at the base of the stairway for personnel safety), ground beds, counterpoises, etc.

Referring to FIGS. 8A-D, the invention also comprises a tubular standoff 210 through which is threaded a by-pass conductor 212 connected at a lower end 212L to the floating roof 214 and an upper end 212U to the upper edge 216 of a tank 218. Preferably, the tubular standoff 210 is composed of a lightweight, electrically nonconductive material such as fiberglass or Kevlar. Preferably, the by-pass conductor 212 is composed of a multitude of fine conductive wires such as would be found in conventional welding cables.

Figure 9A:
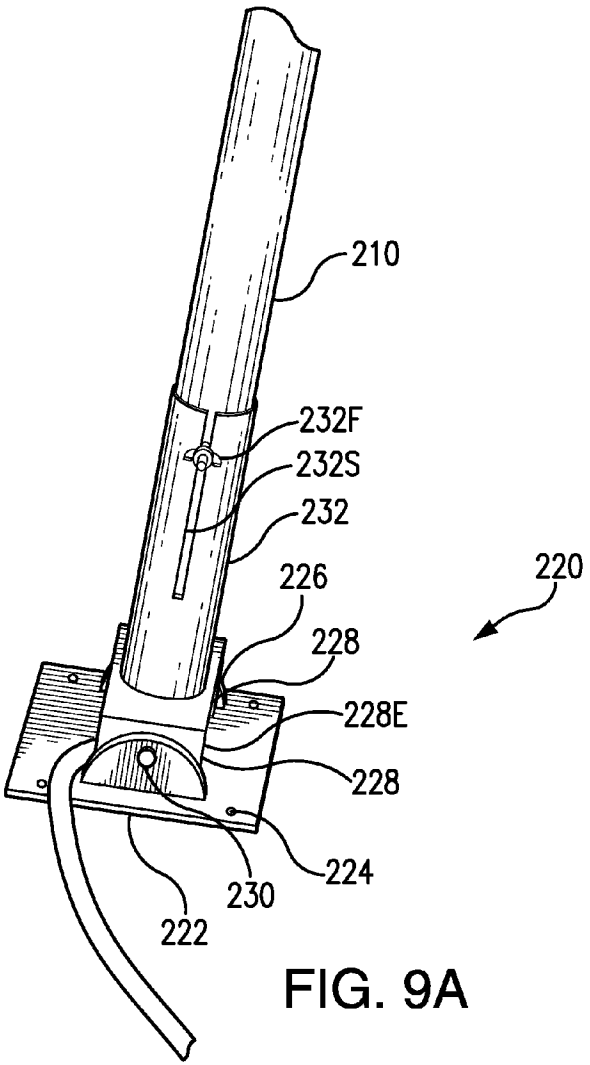
FIGS. 9A-C are perspective views of the unidirectional bracket connecting the lower end of the tubular standoff and the lower end of the by-pass conductor to the floating roof of the tank.
Figure 9B:
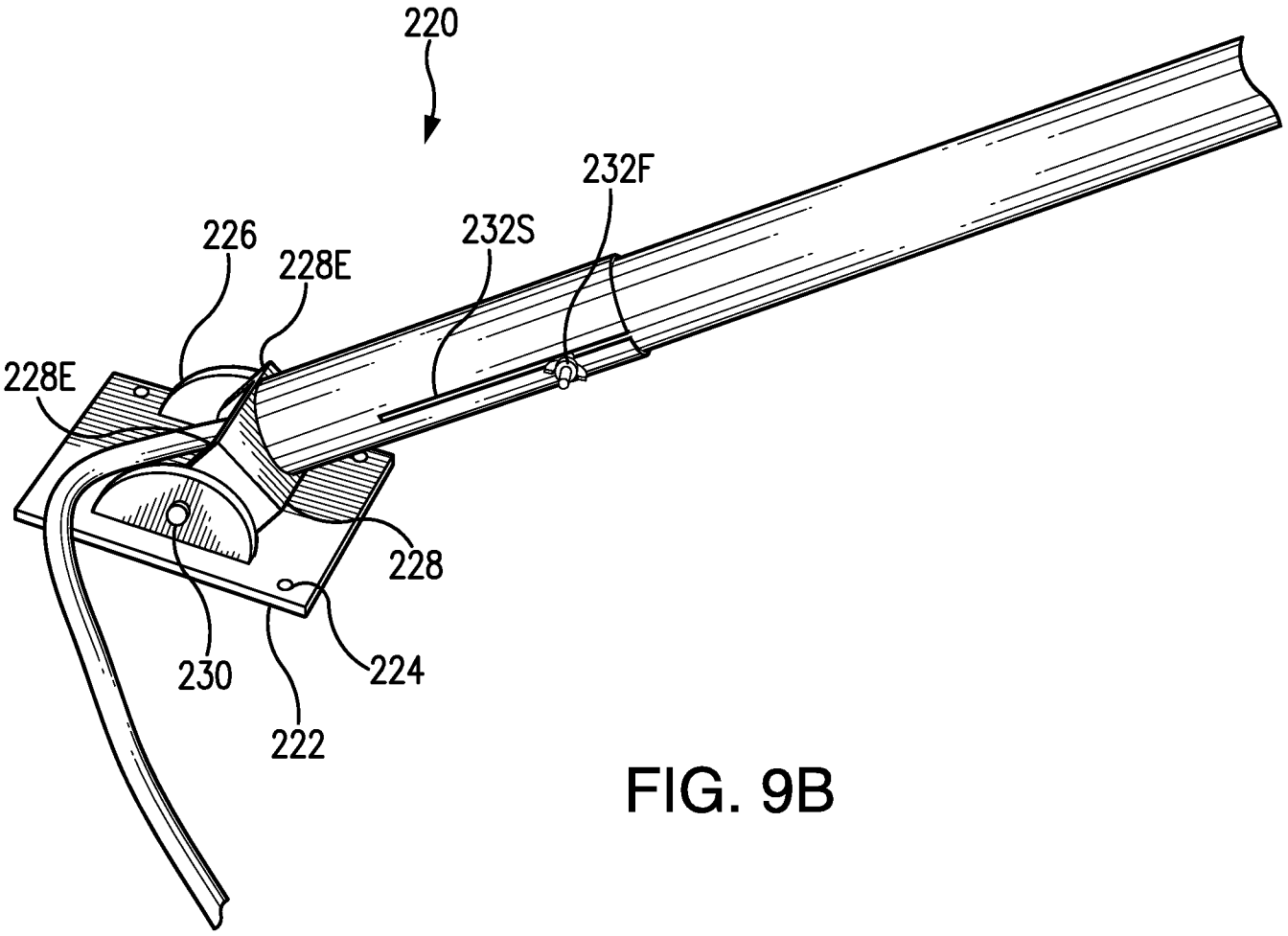

Referring to FIGS. 9A & 9B, the lower end 210L of the tubular standoff 210 attaches mechanically to the perimeter of the floating roof 214 by means of a unidirectional pivotal bracket 220. More specifically, the unidirectional bracket 220 comprises a base plate 222 with four corner holes 224 allowing it to be mechanically connected to the floating roof 214 by threaded fasteners or the like. A pair of opposing upstanding flanges 226 are welded to the base plate 222 to extend upwardly for receiving an inverted U-shaped connector 228 having a pair of opposing ears 228E that fit between the corresponding flanges 226. A bolt 230 extends through aligned holes in the flanges 226 and ears 228E to create a pivotal connection therebetween.

A tubular socket 232 is welded to the flat portion of the U-shaped connector 228 for receiving the lower end 212L of the tubular standoff 212. The socket 232 is preferably slotted 232S and includes a tension fastener 232F to allow tightening about the lower end 212L of the tubular standoff 212 to mechanically secure it in the socket 232.

It is noted that the pivotal connection between the flanges 226 and ears 228E assure that the tubular standoff 210 may pivot only in one arc (i.e., unidirectional) thereby defining the unidirectional pivoting of the tubular standoff 210 along such arc. In this manner, the base plate 222 may be fastened to the floating roof 214 at an orientation to miss any upstanding protuberances that might exist on the roof 214 as the tubular standoff 210 pivots from its generally horizontal position when the floating roof 214 is at its highest position (e.g., tank 218 is full) (see FIG. 8A) to its tilted upward position when the floating roof 214 is at its lowest position (e.g., tank 218 is empty) (see FIG. 8D).

Still referring to FIGS. 9A & 9B, the by-pass conductor 212 is threaded through the tubular standoff 210 and then through a hole (not shown) formed in the flat portion of the U-shaped connector 228 to then be mechanically and electrically connected the floating roof 214 by means of an eye crimp connector and bolt (not shown).

Figure 9C:
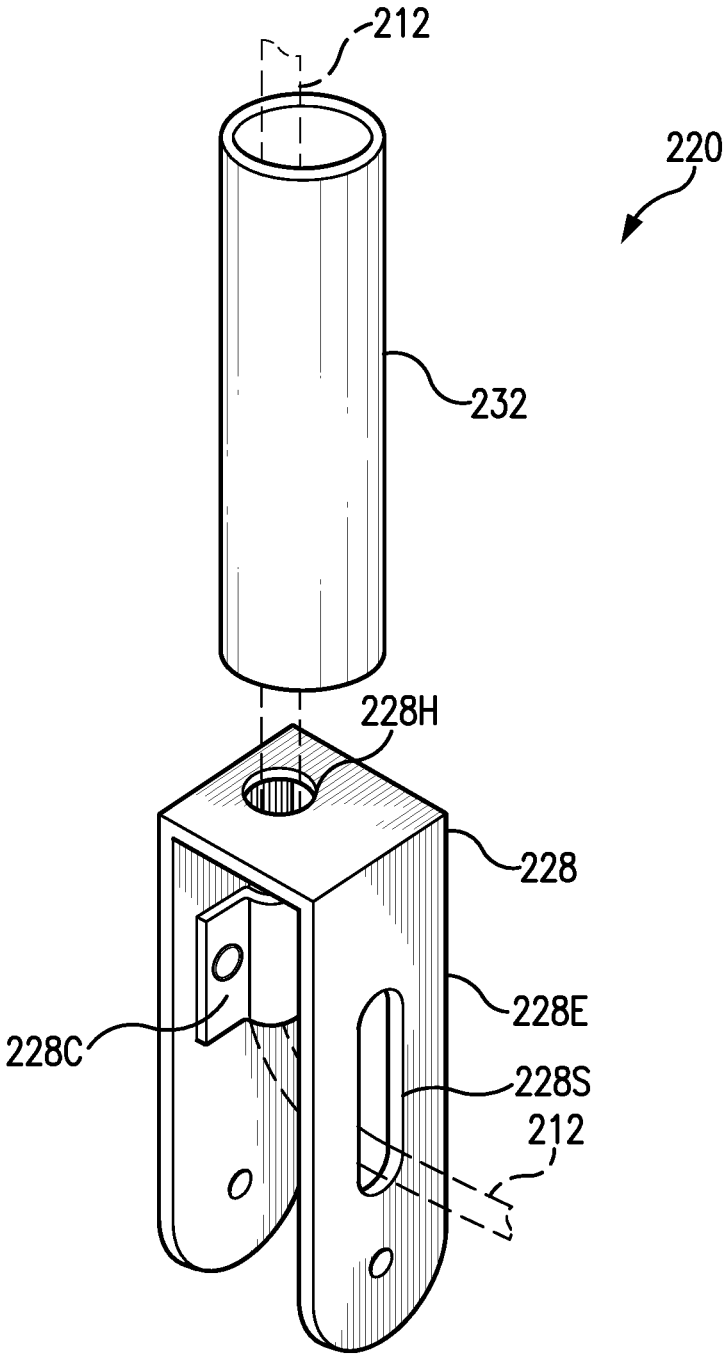
Figure 10A:
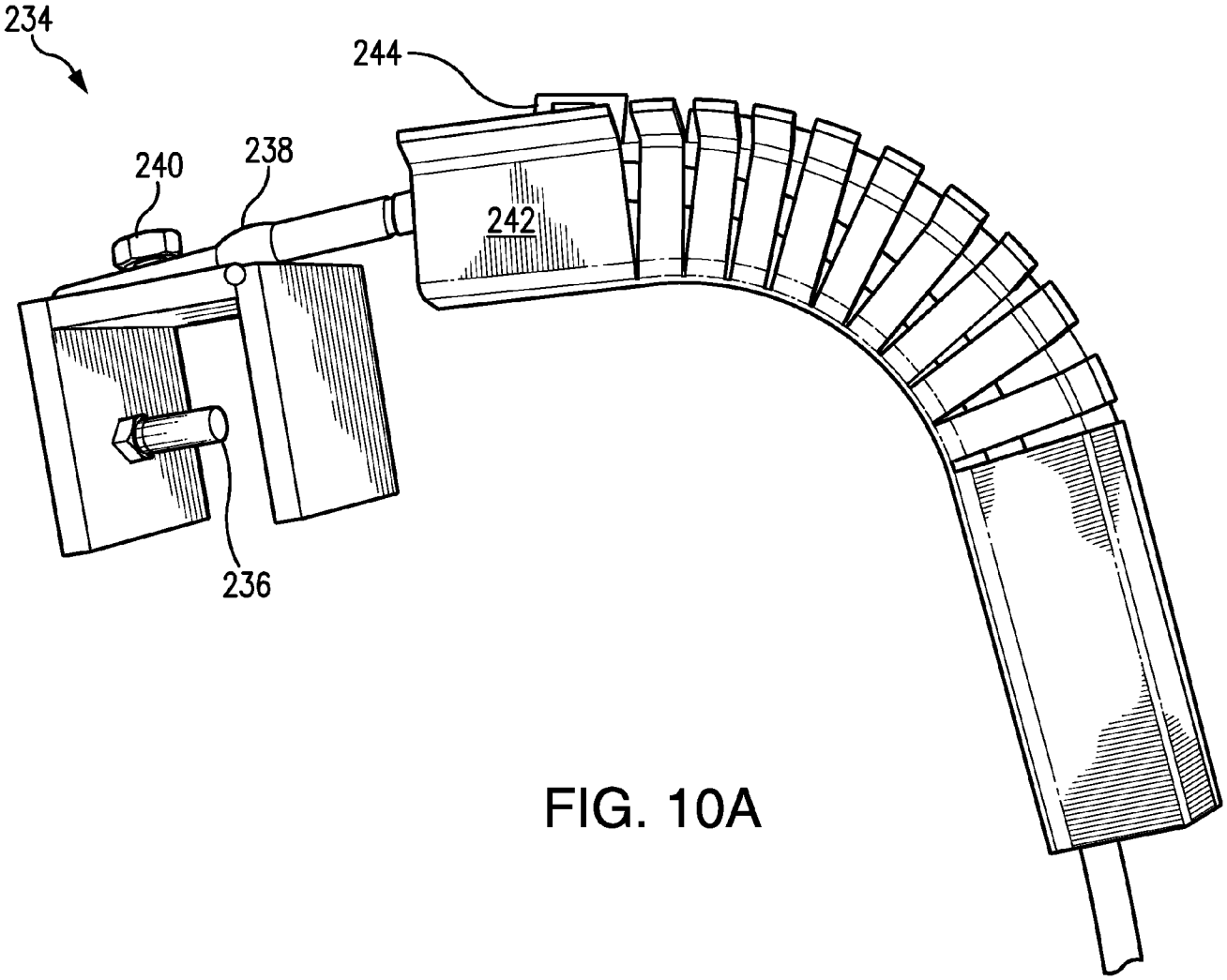
FIGS. 10A-H are perspective views of the rim bracket connecting the upper end of the by-pass conductor to the upper edge of the tank.
Figure 10B:
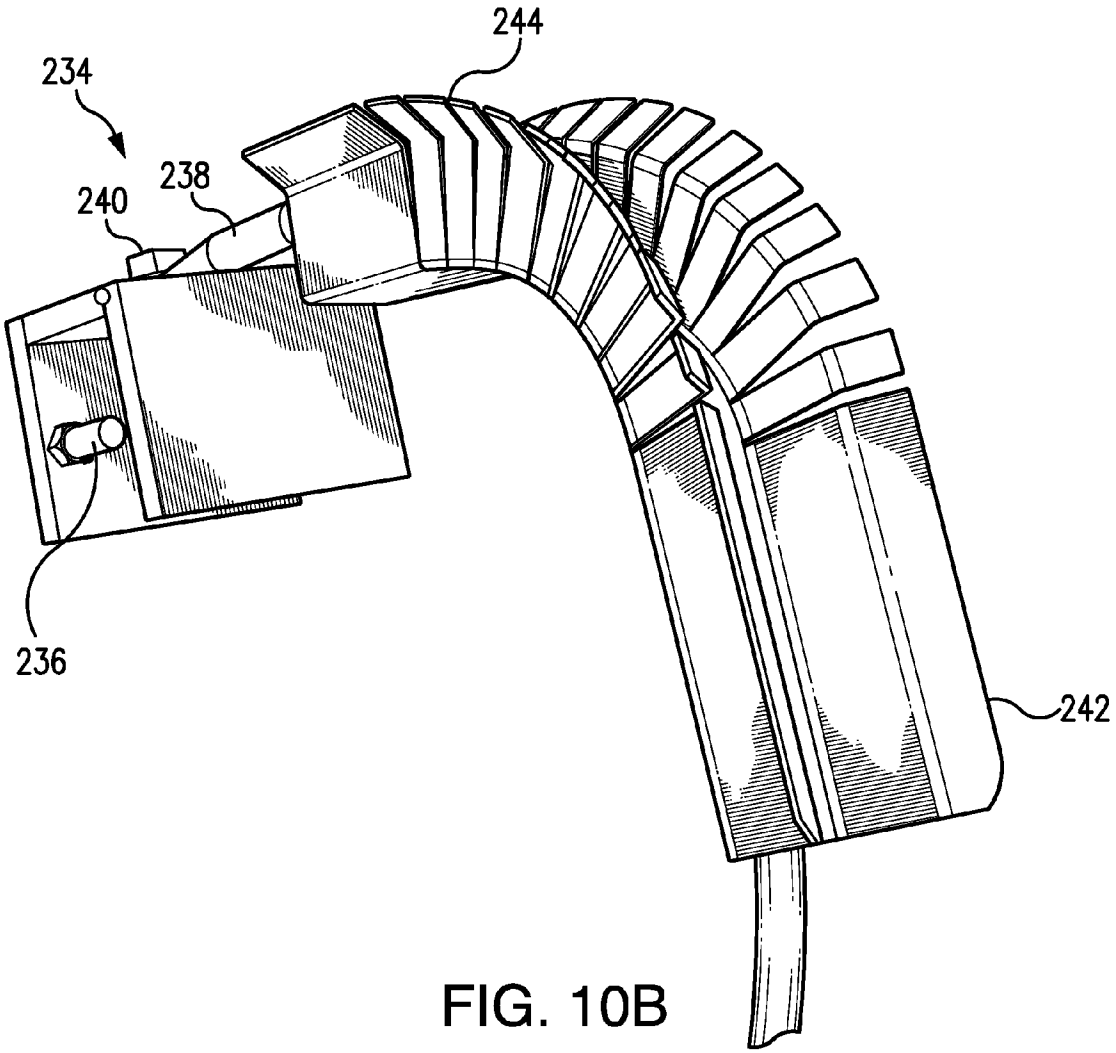
Figure 10D:
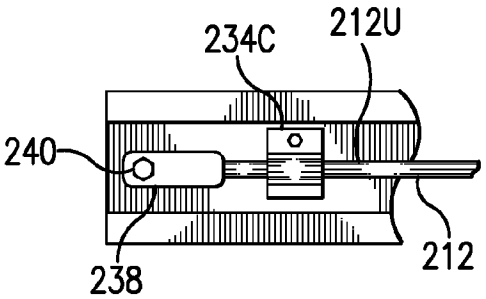
Figure 10C:
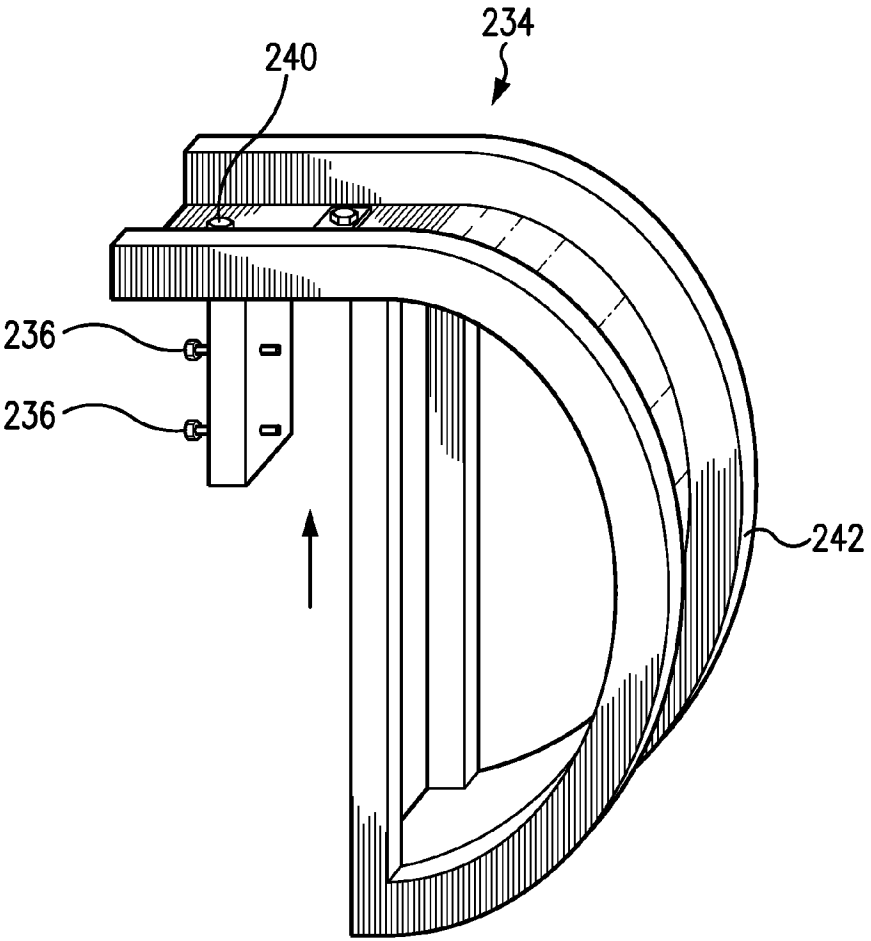
Figure 10E:
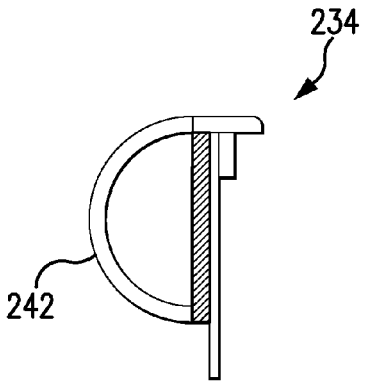
Figure 10F:
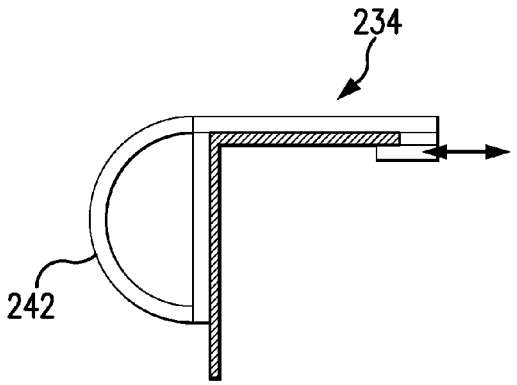
Figure 10G:
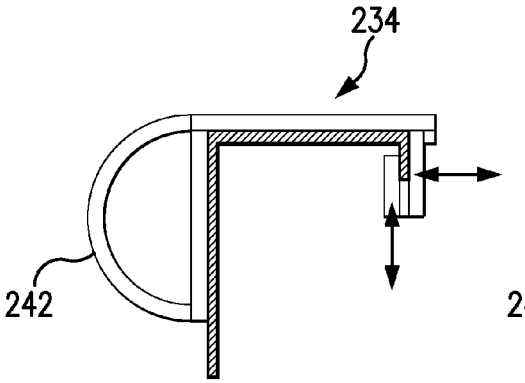
Figure 10H:
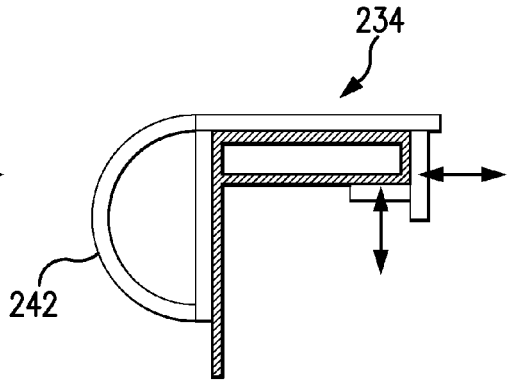

As shown in FIG. 9C, a preferred embodiment of the ears 228E of the U-shaped connector 228 comprises an offset hole 228H formed through the flat portion and one of the elongated ears 228S having an elongated slot 228S formed therethrough. The purpose of the offset hole 228H and elongated slot 228S is to increase the bending radius of the by-pass conductor 212 to minimize chaffing as it passes through the U-shaped connector 228. A cable clamp 228C is attached to the other elongated ear 228S to securely retain the by-pass conductor 212 in the U-shaped member 228, thereby providing some strain relief to the by-pass conductor 212.

Referring now to FIGS. 10A-D, a rim bracket 234 comprising a generally inverted U-shape is provided to be fitted over the upper edge of the tank 218 and electrically and mechanically connected to the upper edge of the tank 218 by means of a threaded bolt 236 threaded through a hole in one of the legs of the U-shaped rim bracket 234.

The upper end 212U of the by-pass conductor 212 is stripped of any insulation and provided with a crimp eye connector 238 whose eye is mechanically and electrically connected to the flat portion of the U-shaped rim bracket 234 by a threaded bolt 240. A cable clamp 234C is connected to the U-shape to securely affix the by-pass conductor 212 thereto and provide additional strain relief The rim bracket 234 includes a downwardly extending arcuate channel 242 that supports the by-pass conductor 212 extending from the rim bracket 234. The radius of the arcuate-shaped channel 242 defines and therefore limits the bending radius of the by-pass conductor 212 extending from the top of the tank 218. The end of the channel 242 may be welded to rim bracket 234 or simply connected to the by-pass conductor 212 adjacent to the eye connector 238 by a cable fastener 244.

FIG. 10E-H show alternative embodiments of the rim bracket 234 designed to accommodate different upper edges of tanks 218 (the upper edges being illustrated in bold).

It is noted that the rim bracket 234 may be positioned along the edge of the tank 218 in alignment with the upper end 210U of the tubular standoff 210 when it is in its uppermost position such that the by-pass conductor 212 is prevented from fouling on any tank appurtenances.

Figure 11:
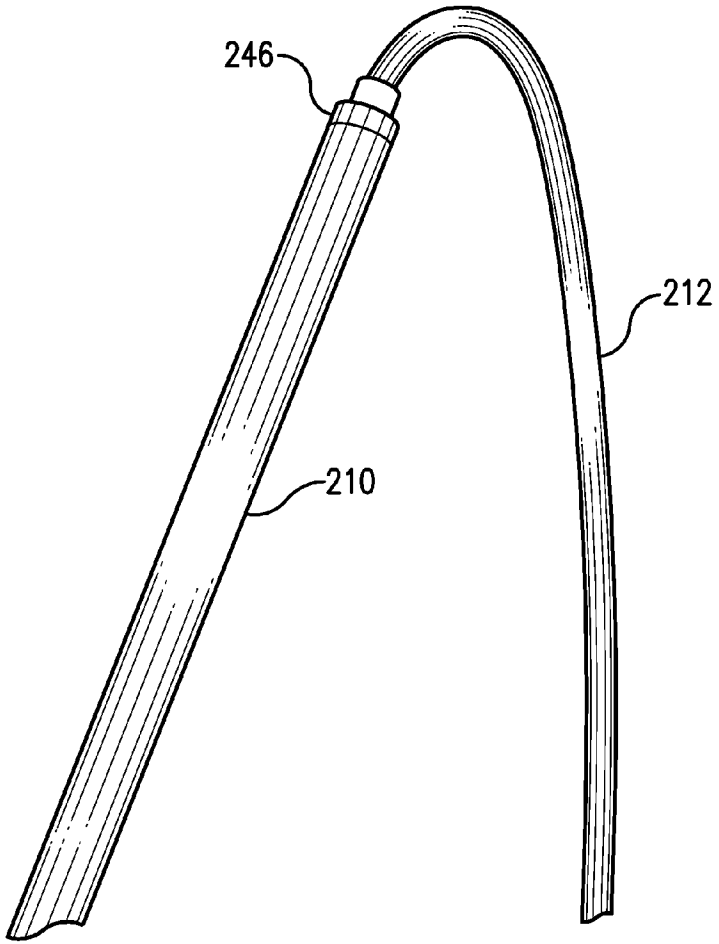
FIG. 11 is a perspective view of the upper end of the tubular standoff showing the by-pass conductor extending therefrom.

Referring to FIG. 11, a strain relief 246 is provided at the uppermost end 210U of the tubular standoff 210 to reduce any chaffing of the by-pass conductor 212 as is exists from the tubular standoff 210.

Figure 11A:
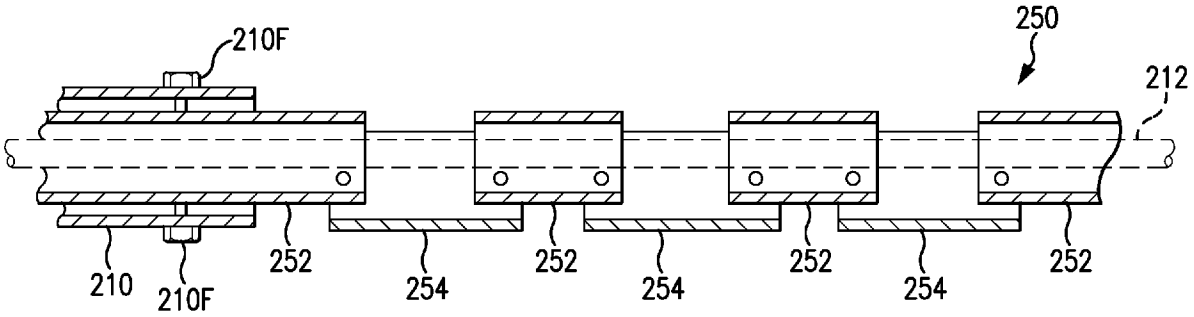
FIGS. 11A and B are longitudinal cross-sectional views of an arcuate channel.
Figure 11B:
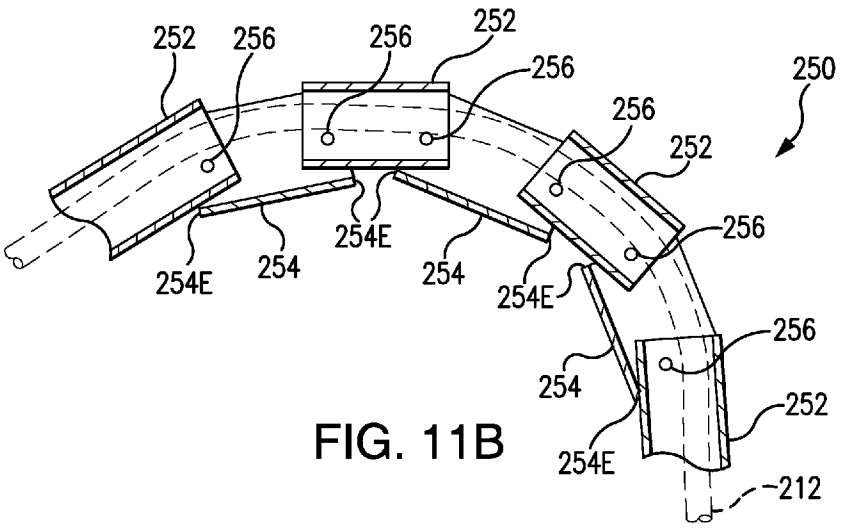
Figure 12:
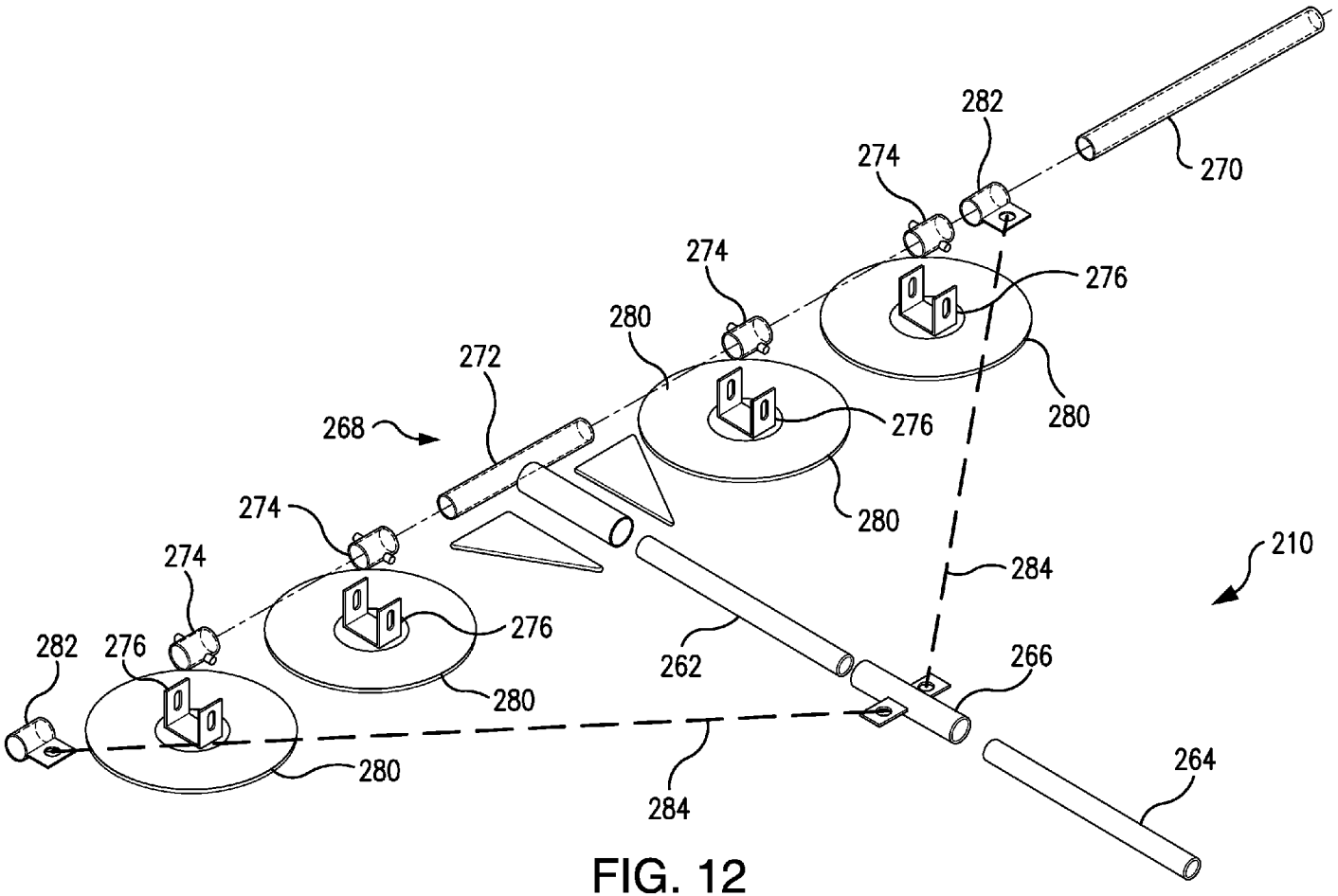
FIG. 12 is a perspective view, partially exploded, of another embodiment of the tubular standoff having guide wires for more controllably guiding the path of the tubular standoff as it raises and lowers.

For added strain-relief protection and to provide more guidance to the by-pass conductor 212 while defining its upward bending radius, another arcuate channel 250 may be provided at the uppermost end 210U of the tubular standoff 210. More particularly, referring to FIGS. 11A and B, the arcuate channel 250 comprises a series of non-conductive rectangular tube segments 252 interconnected by a respective series of non-conductive U-shaped segments 254 pivotally connected by a respective series of hinge pins 256 extending through the respective overlapping ends of the rectangular tube segments 252/U-shaped segments 254. Importantly, the hinge pins 256 are offset from the centerline of the arcuate channel 250 to define a pathway through which the by-pass conductor 212 is threaded. Also importantly, the offset positioning of the hinge pins 256 limit the relative pivoting of the adjacent segments 254/256 thereby defining the minimum diameter that the arcuate channel 250 may be curved into due to the abutting of the edges 254E against the rectangular tube segments 254. Finally, as shown in FIG. 11A, the arcuate channel 250 may be inserted into the tubular standoff 210 and secured therein by means of threaded fasteners 210F or the like.

Alternatively or in addition to the arcuate channel 250, a segment of semi-rigid flex conduit may extend from the upper end 210U of the tubular standoff 210, to provide strain relief and guidance to the by-pass conductor 212.

Another embodiment of the tubular standoff 210 comprises a guywire-supported mast configuration 260. In this embodiment, the tubular standoff 210 comprises a mast 262 and mast extension 264 interconnected by a mast extension adaptor 266, each of which are composed of a non-conductive material.

To allowing pivoting of the mast 262, its bottommost end is connected to a mast receiver assembly 268. The mast receiver assembly 268 comprises a hinge tube receiving tube 272 for rotatably receiving a hinge tube 270. The hinge tube 270 is rotatably connected to the floating roof 214 by means of a series of co-linearly aligned hinge tube receiving tubes 274 mounted to pivot brackets 276 connected to mounting pads 280 affixed to the floating roof 214.

A guy wire tube 282 is connected to the opposing ends of the hinge tube 270. Opposing non-conductive guy wires 284 extend therefrom to the mast extension adaptor 266, thereby providing lateral support to the mast 262/264.

Figure 13A:
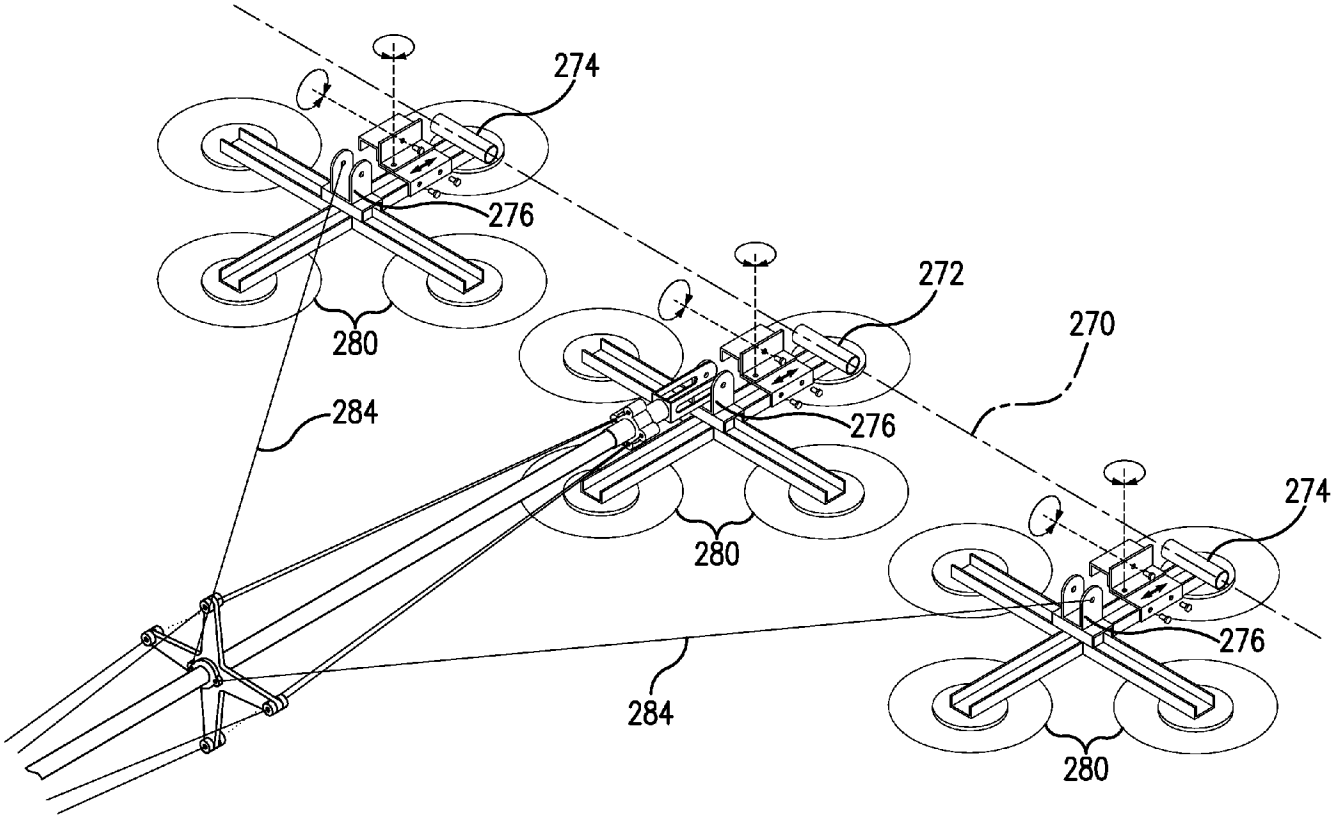
FIGS. 13A-D are perspective views of still another embodiment of the tubular standoff having guides (and the components thereof)
Figures 13B, 13C, 13D:
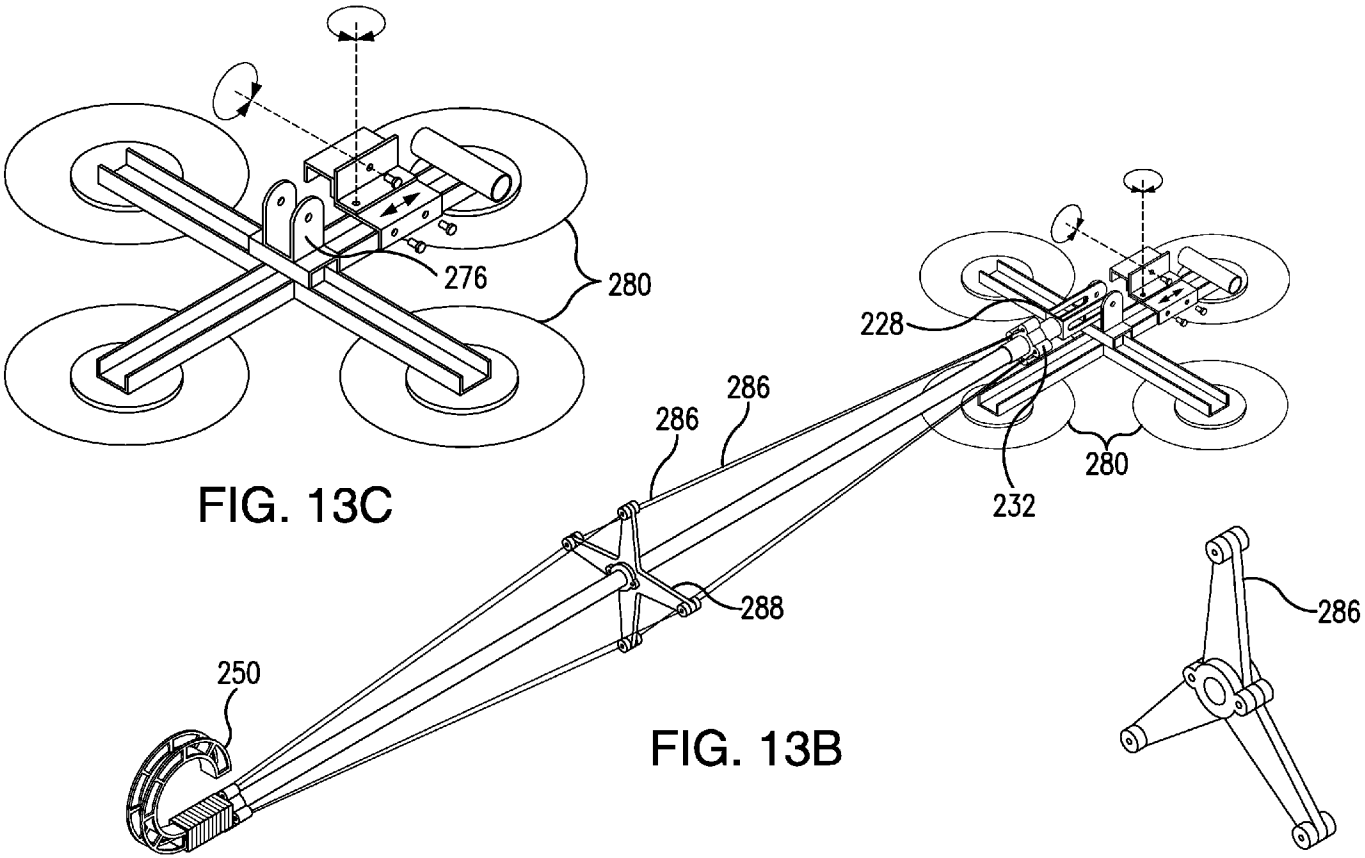

As shown in FIGS. 13A-D, for added support each tube bracket 276 may be more rigidly connected to the floating roof 214 by providing four pads 280. Further, to provide longitudinal support for the mast 262, longitudinal non-conductive guy wires 286 may be provided along its longitudinal length and tensioned by a tensioner 288. Finally, as shown in FIG. 13B, the upper end 210U of the mast 262/tubular standoff 210 may be fitted with a non-conductive arcuate channel 250 to limit the bending radius of the by-pass conductor 212.

Figure 14A:
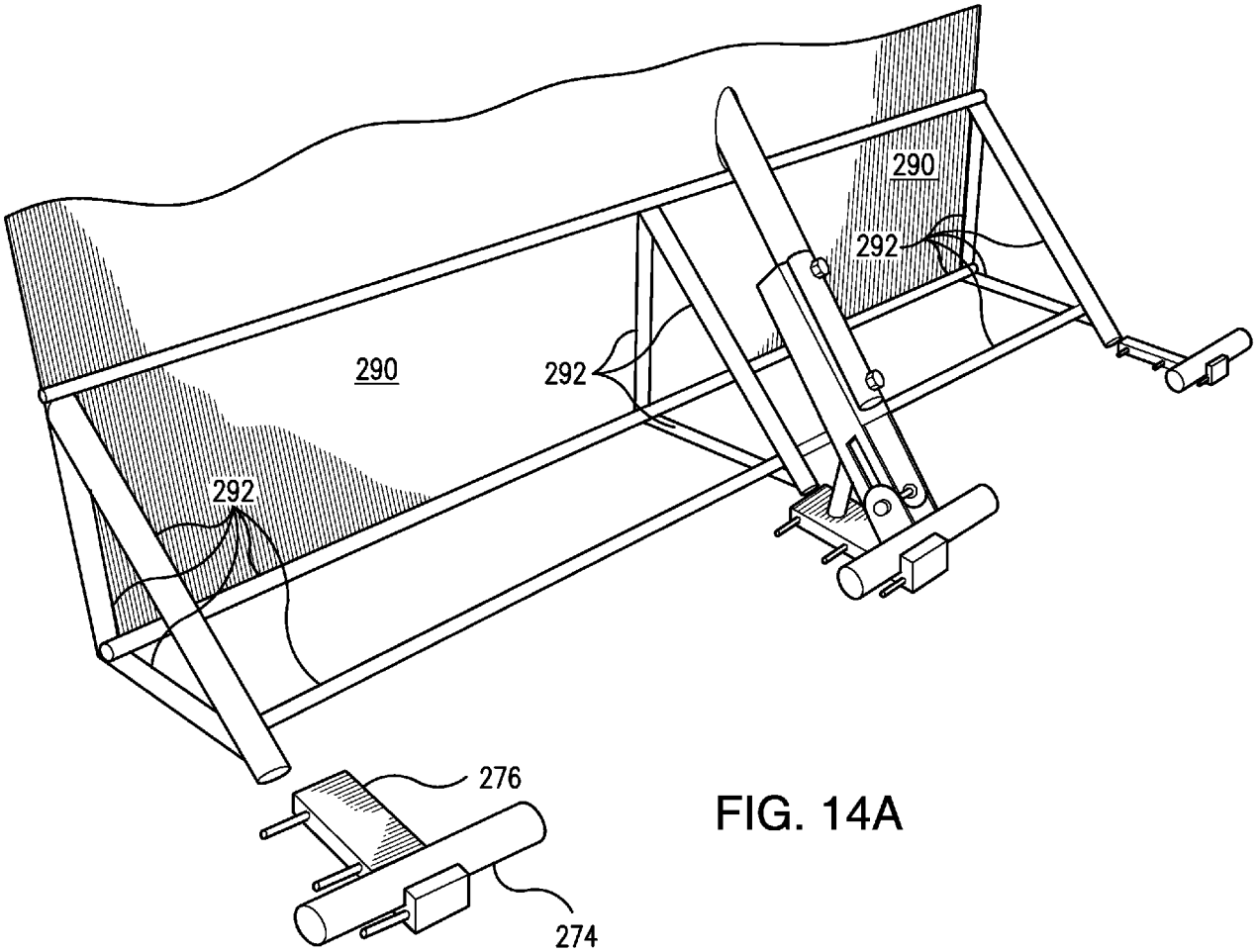
FIGS. 14A-D are perspective views of still another embodiment of the tubular standoff having guides (and the components thereof)
Figure 14B:
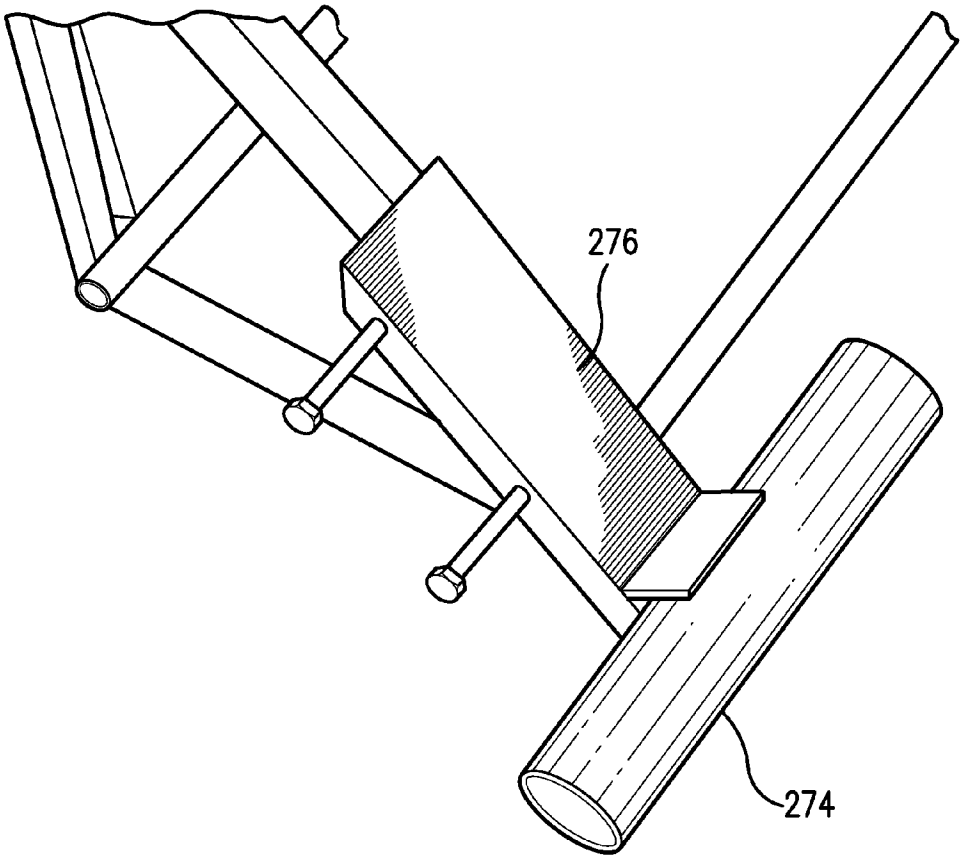

As shown in FIG. 14A, the perimeter of some floating roofs 212 are provided with a knee-height wall 290 supported by a triangular framework 292 to define a space between the wall 290 and the inside of the tank to capture the fire-retardant foam that is released in the event of a fire. These "foam" walls 290 may be used by the present invention to support the guywire embodiments of the invention.

Figure 14C:
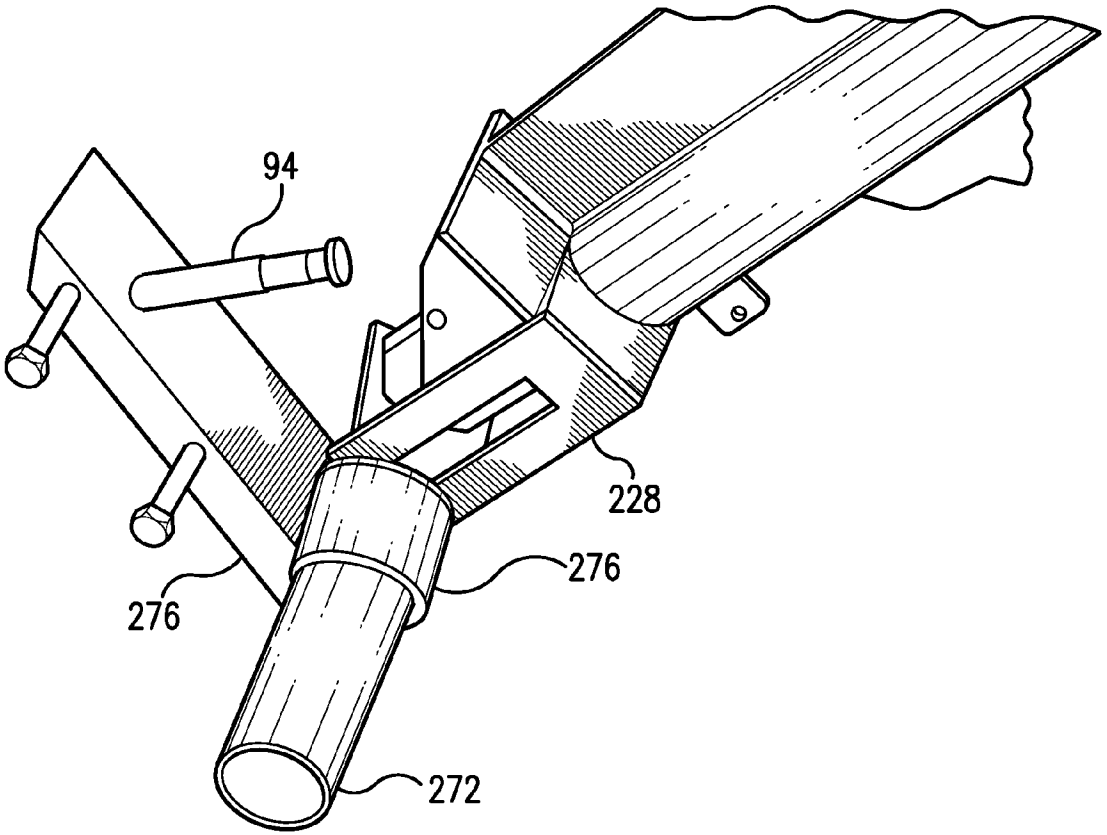
Figure 14D:
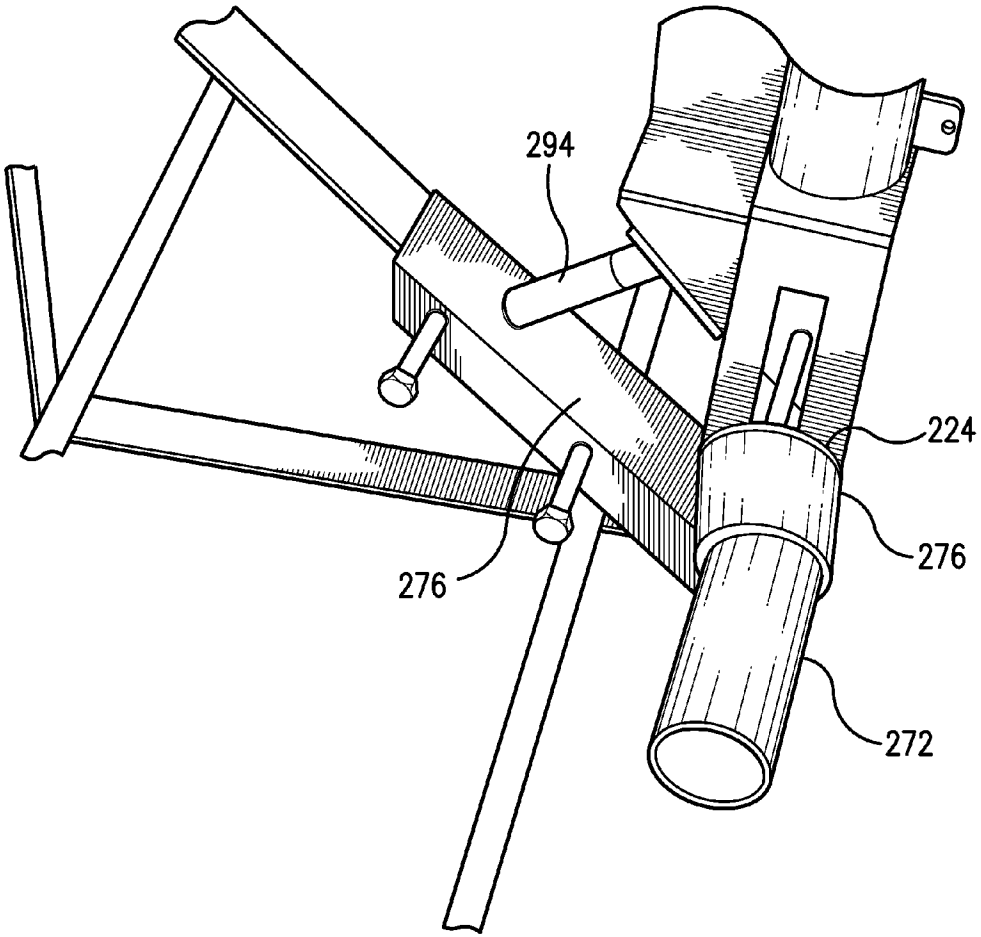
Figure 15:
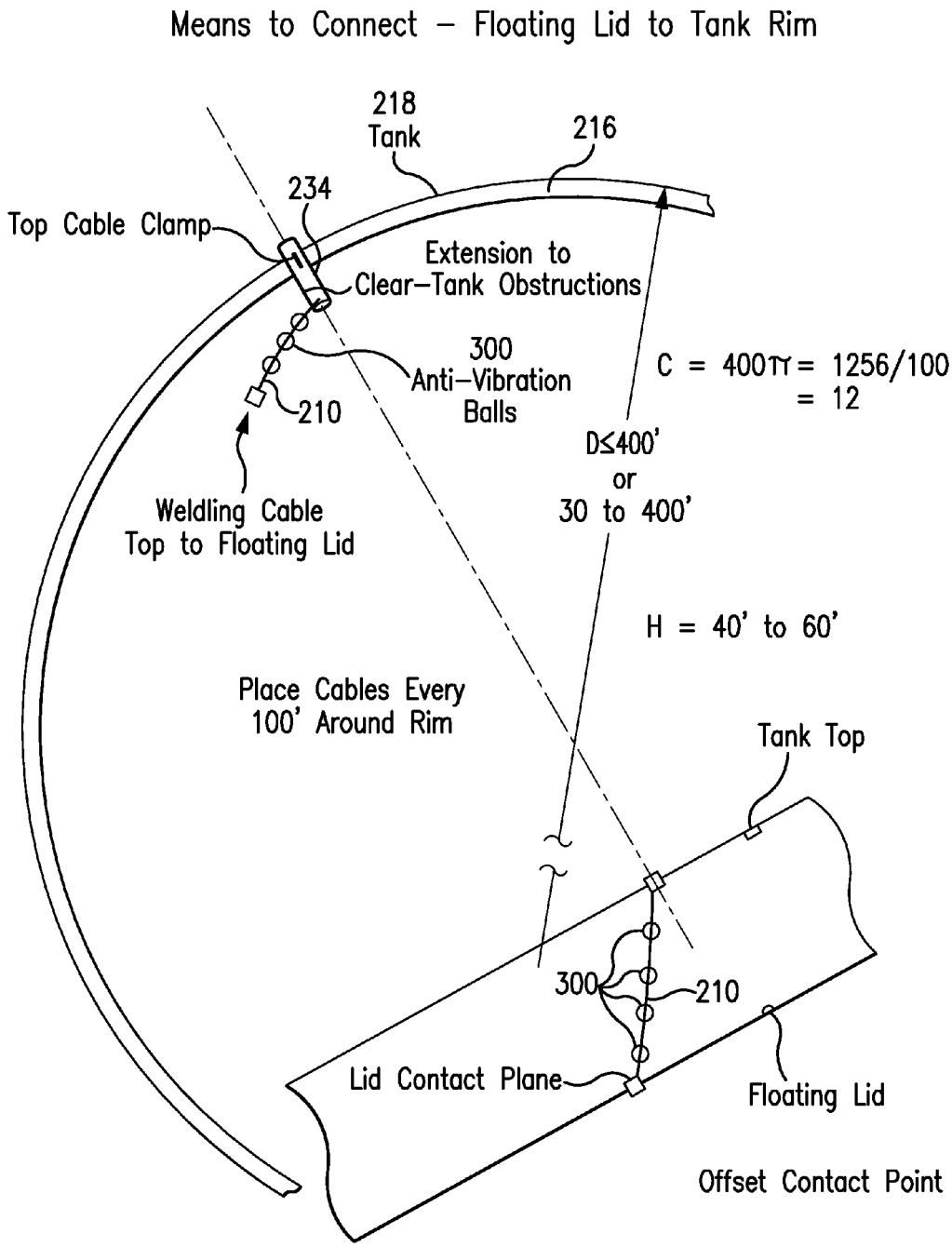
FIG. 15 is a diagrammatic view of another embodiment of the invention including a self-coiling by-pass conductor that interconnects the upper rim and the floating roof of the tank.

More particularly, as shown in FIGS. 14A and B, the tubes 274 may be welded to the brackets 276 which are then in turn bolted to the angular members of the triangular framework 292. As shown in FIGS. 14C and D, the center bracket 276 may b provided with an adjustable stop 294 to limit the backward travel of the mast 262/tubular standoff 210, thereby preventing it from contacting the inner side of the tank 218.

In lieu of the tubular standoff 210, in another embodiment the invention comprises a helical by-pass conductor 212 having a natural twist that is connected at one end to the upper edge 216 of the tank 218 by the rim bracket 234 and at another end to the floating roof 214. The natural twist of the by-pass conductor 212 urges the by-pass conductor 212 into a coiled mass on top of the floating roof 214 as the roof 214 raises. A plurality of spherical separators 300 are fastened along the length of the by-pass conductor 212 to assure that the coils do not become entangled as they lay down onto or played out from the floating roof 214 and to assure that no part of the by-pass conductor 212 becomes trapped or pinched in the juncture between the outer periphery of the floating roof 214 and the inner tank wall as the by-pass conductor 212 lays down onto or is played out from the floating roof 214.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A grounding system for floating roof tanks, comprising in combination:

a by-pass conductor electrically interconnecting an edge of the tank and the floating roof of the tank;

a tubular standoff comprising an elongated hollow structure through which is loosely threaded said by-pass conductor ; and a bracket for connecting said tubular standoff to the floating roof.

2. The grounding system set forth in claim 1, wherein said bracket comprises a unidirectional bracket whose position is dependent on the position of the floating roof which prevents the by-pass conductor from fouling on tank appurtenances.

3. The grounding system as set forth in claim 2, further including a rim bracket fitted to an upper edge of the floating roof tank including a flexible arcuate channel that supports the by-pass conductor, defines its bending radius from the top of the tank and prevents the by-pass conductor from fouling on tank appurtenances.

4. The grounding system as set forth in claim 1, further including an arcuate channel connected to an upper end of said tubular standoff that supports the by-pass conductor, defines its bending radius as it exits said tubular standoff and prevents the by-pass conductor from fouling on tank appurtenances.

* * * * *